US009982690B2

(12) United States Patent
Jagoda

(10) Patent No.: US 9,982,690 B2
(45) Date of Patent: May 29, 2018

(54) DIGITAL HYDRAULIC TRANSFORMER AND METHOD FOR RECOVERING ENERGY AND LEVELING HYDRAULIC SYSTEM LOADS

(71) Applicant: Eaton Corporation, Cleveland, OH (US)

(72) Inventor: Aaron Hertzel Jagoda, St. Louis Park, MN (US)

(73) Assignee: Eaton Intelligent Power Limited, Dublin (IE)

( * ) Notice: Subject to any disclaimer, the term of this patent is extended or adjusted under 35 U.S.C. 154(b) by 1169 days.

(21) Appl. No.: 13/780,553

(22) Filed: Feb. 28, 2013

(65) Prior Publication Data

US 2013/0232963 A1 Sep. 12, 2013

Related U.S. Application Data

(60) Provisional application No. 61/604,276, filed on Feb. 28, 2012.

(51) Int. Cl.

| | |
|---|---|
| ***F15B 21/14*** | (2006.01) |
| ***F15B 1/02*** | (2006.01) |
| ***E02F 9/22*** | (2006.01) |

(52) U.S. Cl.

CPC ..... *F15B 1/02* (2013.01); *E02F 9/2217* (2013.01); *E02F 9/2296* (2013.01); *F15B 21/14* (2013.01);

(Continued)

(58) Field of Classification Search

CPC ..... F15B 1/02; F15B 21/14; F15B 2211/214; F15B 2211/212; E02F 9/2217

See application file for complete search history.

(56) References Cited

U.S. PATENT DOCUMENTS 5,251,442 A * 10/1993 Roche ..... F15B 1/00 60/368
5,852,933 A * 12/1998 Schmidt ..... B30B 15/16 100/269.14

(Continued)

FOREIGN PATENT DOCUMENTS

WO WO 97/31185 8/1997
WO WO 2013/025459 A1 2/2013

OTHER PUBLICATIONS http://digitalhydraulic.com/projectsContent.html, 4 pages (Date Printed Sep. 29, 2011).

(Continued)

*Primary Examiner* — F. Daniel Lopez
*Assistant Examiner* — Abiy Teka
(74) *Attorney, Agent, or Firm* — Merchant & Gould P.C.

(57) ABSTRACT

A hydraulic system that includes a rotating group with a plurality of fluid chambers and a plurality of valve sets that valve a corresponding one of the fluid chambers is disclosed. The hydraulic system may function as a hydraulic transformer. The hydraulic system may transfer energy between a high pressure fluid supply (e.g., from a pump), an accumulator, a hydraulic component (e.g., a hydraulic cylinder, a hydraulic motor, and/or a hydraulic pump-motor), and/or an input/output shaft. The hydraulic system may include a single rotating group with a common axis. Each of the valve sets may include a first valve that fluidly connects to the pump, a second valve that fluidly connects to a tank, a third valve that fluidly connects to the accumulator, and a fourth valve that fluidly connects to the hydraulic component. The valves may have a valving period set to less than half or one-third of a rotational period of the rotating group. The valves may have a frequency of greater than 100 Hertz and may be digitally controlled.

33 Claims, 25 Drawing Sheets

(52) U.S. Cl.
CPC ..... *F15B 2211/20546* (2013.01); *F15B 2211/20569* (2013.01); *F15B 2211/212* (2013.01); *F15B 2211/214* (2013.01); *F15B 2211/328* (2013.01); *F15B 2211/6309* (2013.01); *F15B 2211/6313* (2013.01); *F15B 2211/6336* (2013.01); *F15B 2211/6346* (2013.01); *F15B 2211/7058* (2013.01); *F15B 2211/88* (2013.01)

(56) References Cited

U.S. PATENT DOCUMENTS

| | | | | |
|---|---|---|---|---|
| 6,378,301 | B2 * | 4/2002 | Endo | E02F 9/2217 60/414 |
| 7,475,538 | B2 | 1/2009 | Bishop | |
| 8,226,370 | B2 | 7/2012 | Wu et al. | |
| 8,235,676 | B2 | 8/2012 | Armstrong et al. | |
| 2005/0042121 | A1 * | 2/2005 | Suzuki | E02F 9/2217 417/440 |
| 2005/0226757 | A1 * | 10/2005 | O'Brien, II | F04C 2/10 418/61.3 |
| 2006/0051223 | A1 * | 3/2006 | Mark | F04B 1/20 417/437 |
| 2007/0071609 | A1 | 3/2007 | Gardner | |
| 2008/0104955 | A1 | 5/2008 | Khalil | |
| 2009/0123313 | A1 | 5/2009 | Armstrong et al. | |
| 2009/0293971 | A1 | 12/2009 | Stretch | |
| 2009/0294710 | A1 | 12/2009 | Stretch | |
| 2010/0012204 | A1 | 1/2010 | Stretch et al. | |
| 2011/0278068 | A1 | 11/2011 | Law et al. | |

OTHER PUBLICATIONS http://digitalhydraulic.com/technoContent.html, 6 pages (Date Printed Sep. 29, 2011).

Hydraulic ram, Wikipedia, the free encyclopedia, 4 pages (Sep. 12, 2011).

International Search Report and Written Opinion for PCT/US2013/028263 dated Jun. 12, 2013.

Sgro, S. et al., "Energierückgewinnungs-systeme für Baggerausleger," O + P Olhydraulik and Pneumatik, Vereinigte Fachverlage, Manz, DE, vol. 54, No. 10, pp. 383-389 (Oct. 2010).

* cited by examiner

DIGITAL HYDRAULIC TRANSFORMER AND METHOD FOR RECOVERING ENERGY AND LEVELING HYDRAULIC SYSTEM LOADS

BACKGROUND

Mobile pieces of machinery (e.g., excavators) often include hydraulic systems having hydraulically powered linear and rotary actuators used to power various active machine components (e.g., linkages, tracks, rotating joints, etc.). Typically, the linear actuators include hydraulic cylinders and the rotary actuators include hydraulic motors. By accessing a user interface of a machine control system, a machine operator can control movement of the various machine components.

A typical piece of mobile machinery includes a prime mover (e.g., a diesel engine, spark ignition engine, electric motor, etc.) that functions as an overall source of power for the piece of mobile machinery. Commonly, the prime mover powers one or more hydraulic pumps that provide pressurized hydraulic fluid for driving the active machine components of the piece of machinery. The prime mover is typically required to be sized to satisfy a peak power requirement of the system. Because the prime mover is designed to satisfy peak power requirements, the prime mover often does not operate at peak efficiency under average working loads.

The operation of the active hydraulic components of the type described above can be characterized by frequent accelerations and decelerations (e.g., overrunning hydraulic loads). Due to throttling, there is often substantial energy loss associated with decelerations. There is a need for improved systems for recovering energy losses associated with such decelerations.

SUMMARY

One aspect of the present disclosure relates to systems and methods for effectively recovering and utilizing energy from overrunning hydraulic loads.

Another aspect of the present disclosure relates to systems and methods for leveling the load on a hydraulic systems prime mover by efficiently storing energy during periods of low loading and efficiently releasing stored energy during periods of high loading, thus allowing the prime mover to be sized for average power requirement rather than for a peak power requirement. Such systems and methods also permit the prime mover to be run at a more consistent operating condition which allows an operating efficiency of the prime mover to be optimized.

A further aspect of the present disclosure relates to a hydraulic system including a hydraulic transformer capable of providing shaft work against an external load. In certain embodiments, a clutch can be used to engage and disengage the output shaft from the external load such that the unit can also function as a stand-alone hydraulic transformer.

Still another aspect of the present disclosure relates to a hydraulic system that includes an accumulator and a hydraulic transformer. The hydraulic transformer includes a rotating group that is rotationally coupled to a rotatable shaft. The rotatable shaft is adapted for connection to an external load. The hydraulic transformer further includes a plurality of valve sets. Each of the valve sets includes a first high-speed valve that fluidly connects to a hydraulic pump, a second high-speed valve that fluidly connects to a tank, and a third high-speed valve that fluidly connects to the accumulator.

Yet another aspect of the present disclosure relates to a hydraulic system that includes a high pressure hydraulic fluid supply, a low pressure hydraulic fluid reservoir, a rotating group, and a plurality of valve sets. The rotating group includes a plurality of fluid chambers operably connected to a common drive member such that relative rotation between the plurality of fluid chambers and the common drive member is coupled with hydraulic fluid flow. The rotating group has a rotational frequency and a rotational period that corresponding to the relative rotation between the plurality of fluid chambers and the common drive member. Each of the valve sets of the plurality of valve sets valves a corresponding one of the plurality of fluid chambers. Each of the valve sets may include a first valve that fluidly connects and disconnects the corresponding one of the plurality of fluid chambers with the high pressure hydraulic fluid supply, a second valve that fluidly connects and disconnects the corresponding one of the plurality of fluid chambers with the low pressure hydraulic fluid reservoir, a third valve that fluidly connects and disconnects the corresponding one of the plurality of fluid chambers with a hydraulic component, and/or a fourth valve that fluidly connects and disconnects the corresponding one of the plurality of fluid chambers with the hydraulic accumulator. Each of the valves of each of the valve sets may have a valving frequency and a valving period that corresponds to a connect-disconnect-connect cycle of the valve. At least one of the first, second, third, and/or fourth valves is adapted to operate with the valving period set to less than half or less than one-third of the rotational period of the rotating group.

Still another aspect of the present disclosure relates to a hydraulic transformer that is adapted to transfer hydraulic flow energy between a first hydraulic flow, with a first pressure and a first flow rate, and a second hydraulic flow, with a second pressure and a second flow rate. The hydraulic transformer includes a single rotating group. The single rotating group includes a plurality of fluid chambers that are operably connected to a common drive member such that relative rotation about a single axis between the plurality of fluid chambers and the common drive member is coupled with hydraulic fluid flow through the hydraulic transformer.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to aspects of the present disclosure that are illustrated in the accompanying drawings. Wherever possible, the same reference numbers will be used throughout the drawings to refer to the same or like structure.

Figure 1:
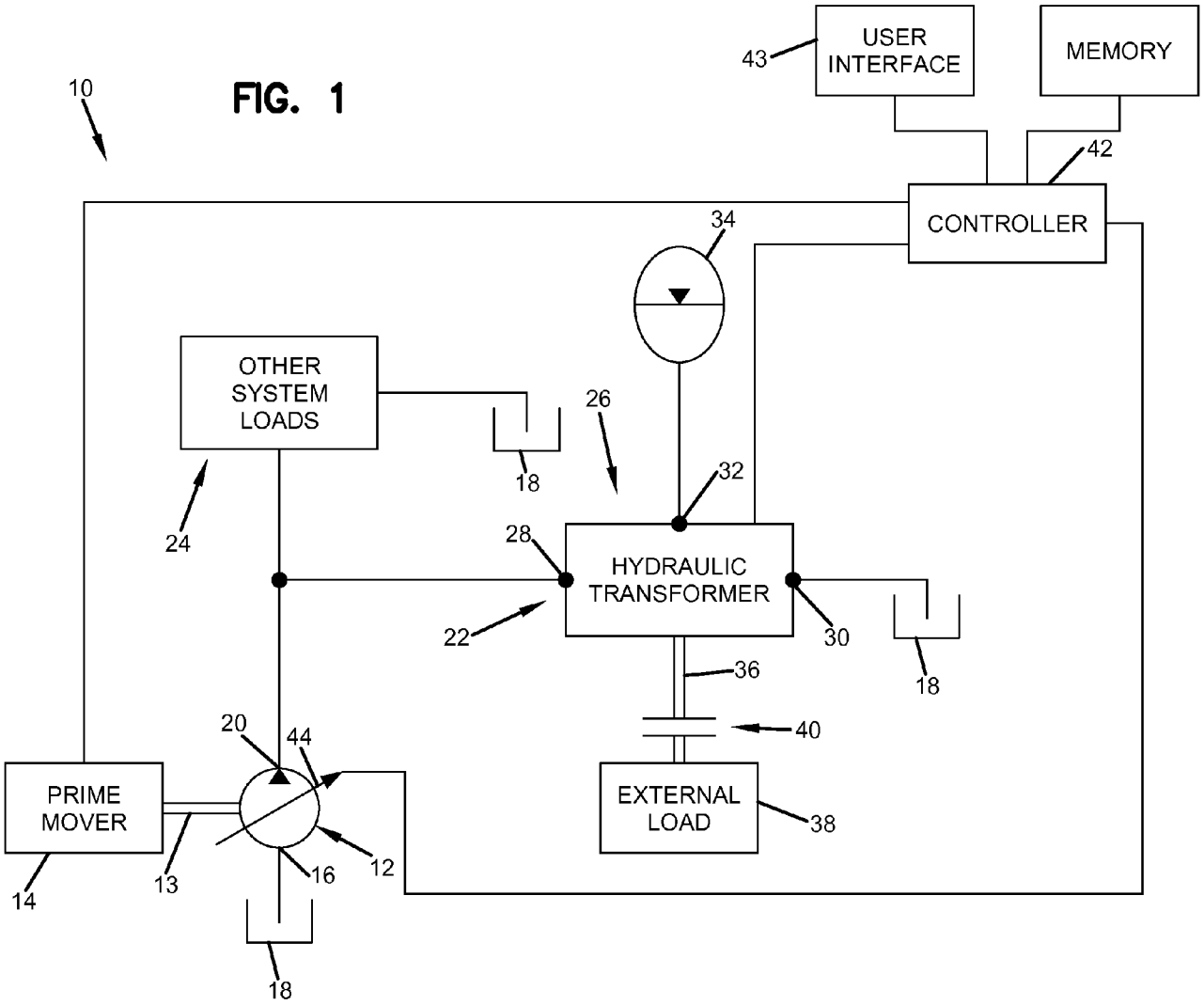
FIG. 1 is a schematic diagram of a first hydraulic system in accordance with the principles of the present disclosure.

FIG. 1 shows a system 10 in accordance with the principles of the present disclosure. The system 10 includes a variable displacement pump 12 driven by a prime mover 14 (e.g., a diesel engine, a spark ignition engine, an electric motor or other power source). The variable displacement pump 12 includes an inlet 16 that draws low pressure hydraulic fluid from a tank 18 (i.e., a low pressure reservoir). The variable displacement pump 12 also includes an outlet 20 through which high pressure hydraulic fluid is output. The outlet 20 is preferably fluidly coupled to a plurality of different working load circuits. For example, the outlet 20 is shown coupled to a first load circuit 22 and a second load circuit 24. The first load circuit 22 includes a hydraulic transformer 26 including a first port 28, a second port 30 and a third port 32. The first port 28 of the hydraulic transformer 26 is fluidly connected to the outlet 20 of the variable displacement pump 12 and is also fluidly connected to the second load circuit 24. The second port 30 is fluidly connected to the tank 18. The third port 32 is fluidly connected to a hydraulic pressure accumulator 34. The hydraulic transformer 26 further includes an output/input shaft 36 that couples to an external load 38. A clutch 40 can be used to selectively engage the output/input shaft 36 with the external load 38 and disengage the output/input shaft 36 from the external load 38. When the clutch 40 engages the output/input shaft 36 with the external load 38, torque is transferred between the output/input shaft 36 and the external load 38. In contrast, when the clutch 40 disengages the output/input shaft 36 from the external load 38, no torque is transferred between the output/input shaft 36 and the external load 38. Gear reductions can be provided between the clutch 40 and the external load 38.

The system 10 further includes an electronic controller 42 that interfaces with the prime mover 14, the variable displacement pump 12, and the hydraulic transformer 26. It will be appreciated that the electronic controller 42 can also interface with various other sensors and other data sources provided throughout the system 10. For example, the electronic controller 42 can interface with pressure sensors incorporated into the system 10 for measuring the hydraulic pressure in the accumulator 34, the hydraulic pressure provided by the variable displacement pump 12 to the first and second load circuits 22, 24, the pressures at the pump and tank sides of the hydraulic transformer 26 and other pressures. Moreover, the controller 42 can interface with a rotational speed sensor that senses a speed of rotation of the output/input shaft 36. Additionally, the electronic controller 42 can be used to monitor a load on the prime mover 14 and can control the hydraulic fluid flow rate across the variable displacement pump 12 at a given rotational speed of a drive shaft 13 powered by the prime mover 14. In one embodiment, the hydraulic fluid displacement across the variable displacement pump 12 per shaft rotation can be altered by changing the position of a swashplate 44 of the variable displacement pump 12. The controller 42 can also interface with the clutch 40 for allowing an operator to selectively engage and disengage the output/input shaft 36 of the transformer 26 with respect to the external load 38.

The electronic controller 42 can control operation of the hydraulic transformer 26 so as to provide a load leveling function that permits the prime mover 14 to be run at a consistent operating condition (i.e., a steady operating condition) thereby assisting in enhancing an overall efficiency of the prime mover 14. The load leveling function can be provided by efficiently storing energy in the accumulator 34 during periods of low loading on the prime mover 14, and efficiently releasing the stored energy during periods of high loading of the prime mover 14. This allows the prime mover 14 to be sized for an average power requirement rather than a peak power requirement.

Figure 2:
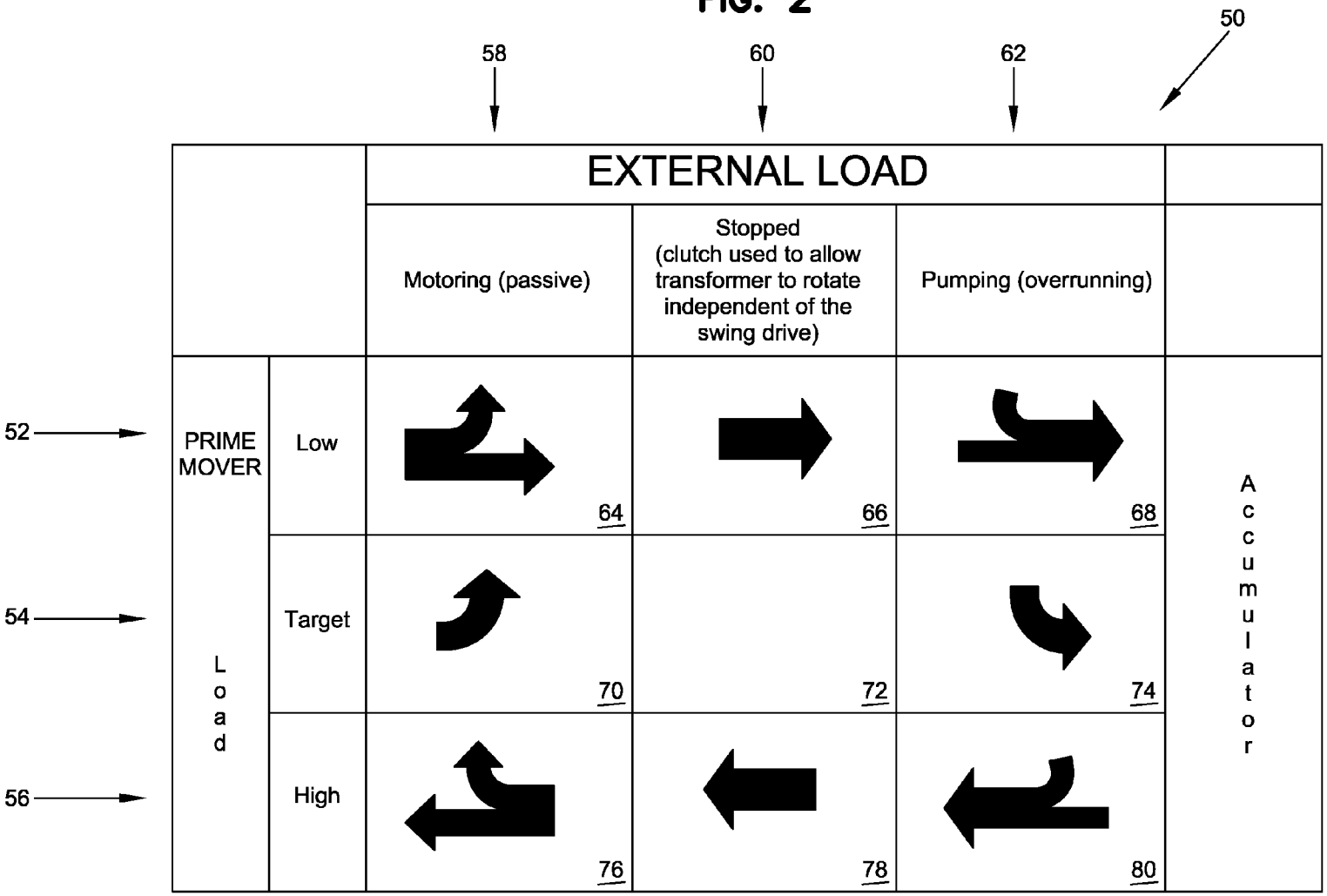
FIG. 2 is a matrix table that schematically depicts various operating modes in which the first hydraulic system of FIG. 1 can operate.

FIG. 2 illustrates a matrix table 50 that schematically depicts an overview of control logic that can be utilized by the electronic controller 42 in controlling the operation of the system 10. It will be appreciated that the matrix table 50 is a simplification and does not take into consideration certain factors such as the state of charge of the accumulator 34. A primary goal of the control logic/architecture is to maintain a generally level loading on the prime mover 14, thus allowing for more efficient operation of the prime mover 14. The control logic/architecture also can reduce the system peak power requirement thereby allowing a smaller prime mover to be used. This is accomplished by using the accumulator 34 and transformer 26 to recover energy from a first working circuit powered by the prime mover 14, and to use the recovered energy as a power supplement for powering a second working circuit powered by the prime mover 14. The accumulator 34 and the transformer 26 can also be used to buffer the energy produced by the prime mover 14. The accumulator 34 and the transformer 26 can further be used to recover energy associated with load decelerations in a way that can eliminate hydraulic throttling.

Referring to FIG. 2, the matrix table 50 includes a plurality of horizontal rows and a plurality of vertical columns. For example, the horizontal rows include a first row 52 corresponding to a low loading condition of the prime mover 14, a second row 54 corresponding to a target loading condition of the prime mover 14, and a third row 56 corresponding to a high loading condition of the prime mover 14. The vertical columns include a first column 58, a second column 60, and a third column 62. The first column 58 represents a condition where the transformer 26 is providing a motoring function where torque is being transferred from the output/input shaft 36 to the external load 38 through the clutch 40. The second column 60 represents a condition where the output/input shaft 36 is decoupled from the external load 38 by the clutch 40. The third column 62 represents a condition where the transformer 26 is providing a pumping function where torque is being transferred from the external load 38 back through the output/input shaft 36.

Figure 3:
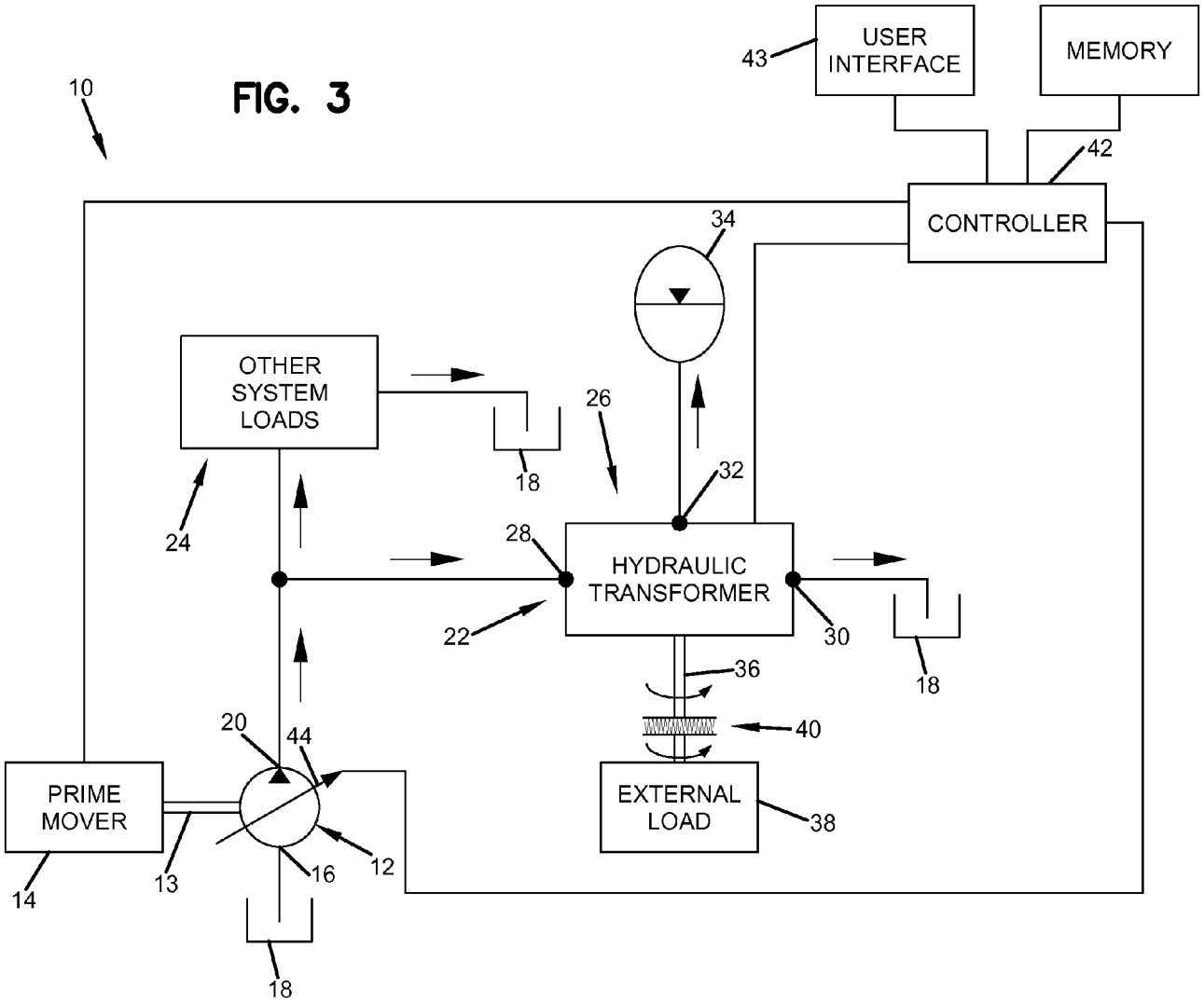
FIGS. 3-11 show the first hydraulic system of FIG. 1 operating in the various operating modes outlined in the matrix table of FIG. 2.

Box 64 of the matrix table 50 represents an operating state/mode where the prime mover 14 is under a low load and the hydraulic transformer 26 is providing a motoring function in which torque is being transferred to the external load 38 through the output/input shaft 36. The system 10 operates in this mode when the electronic controller 42 receives a command from an operator interface 43 (e.g., a control panel, joy stick, toggle, switch, control lever, etc.) instructing the electronic controller 42 to accelerate or otherwise drive the external load 38 through rotation of the output/input shaft 36. In this mode/state, the controller 42 controls operation of the hydraulic transformer 26 such that some hydraulic fluid pressure from the variable displacement pump 12 is used to drive the output/input shaft 36 and the remainder of the hydraulic fluid pressure from the variable displacement pump 12 is used to charge the accumulator 34 (see FIG. 3).

Figure 4:
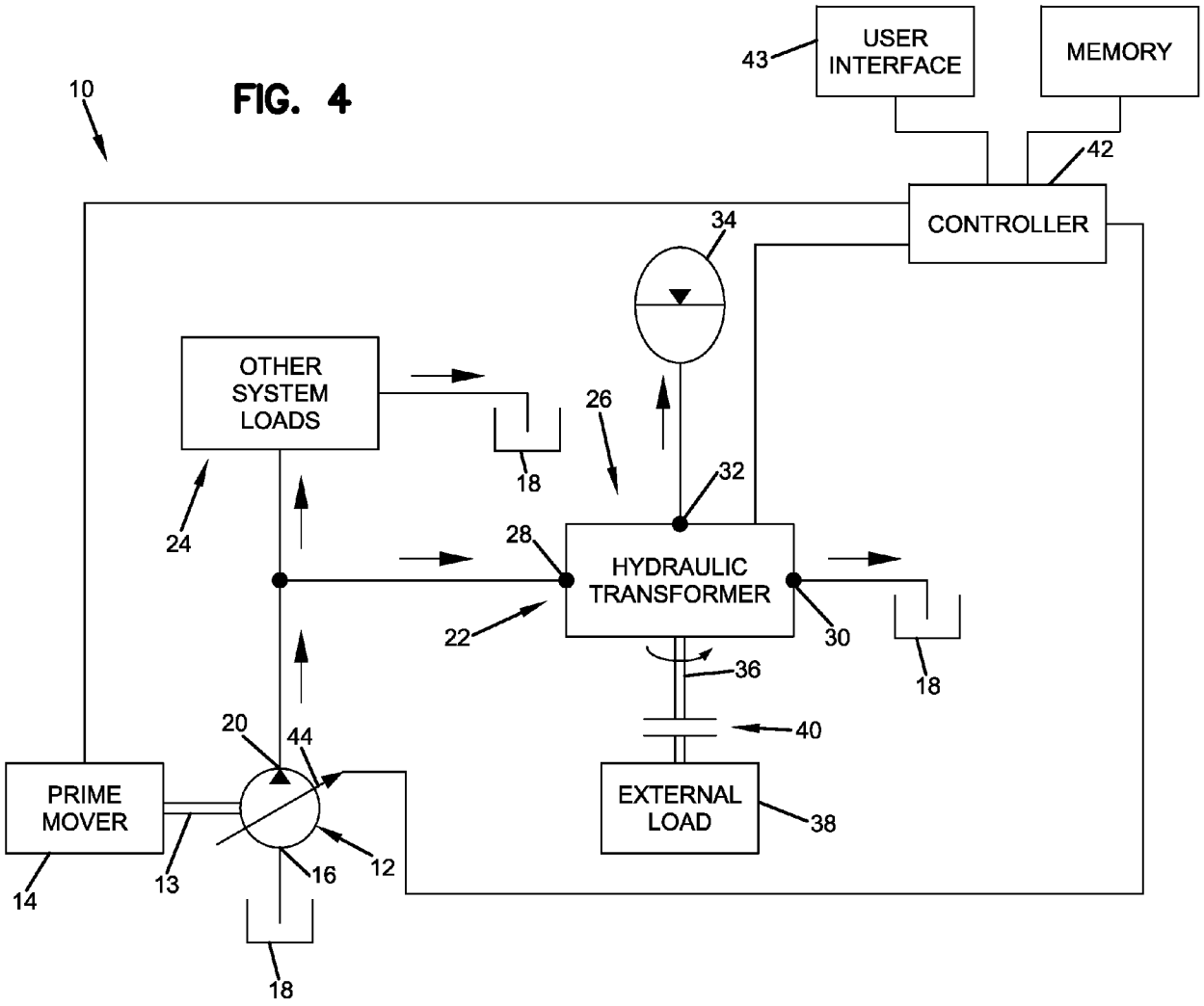

Box 66 of the matrix table 50 represents an operating mode/state where the prime mover 14 is operating under a low load and the output/input shaft 36 is disengaged from the external load 38. In this mode/state, the controller 42 controls operation of the hydraulic transformer 26 such that the transformer 26 functions as a stand-alone transformer in which all excess hydraulic fluid pressure from the variable displacement pump 12 (e.g., excess power not needed by the second working circuit 24) is used to charge the accumulator 34 (see FIG. 4). In this way, the transformer 26 and the accumulator 34 provide an energy buffering function in which otherwise unused energy from the prime mover 14 is stored for later use.

Figure 5:
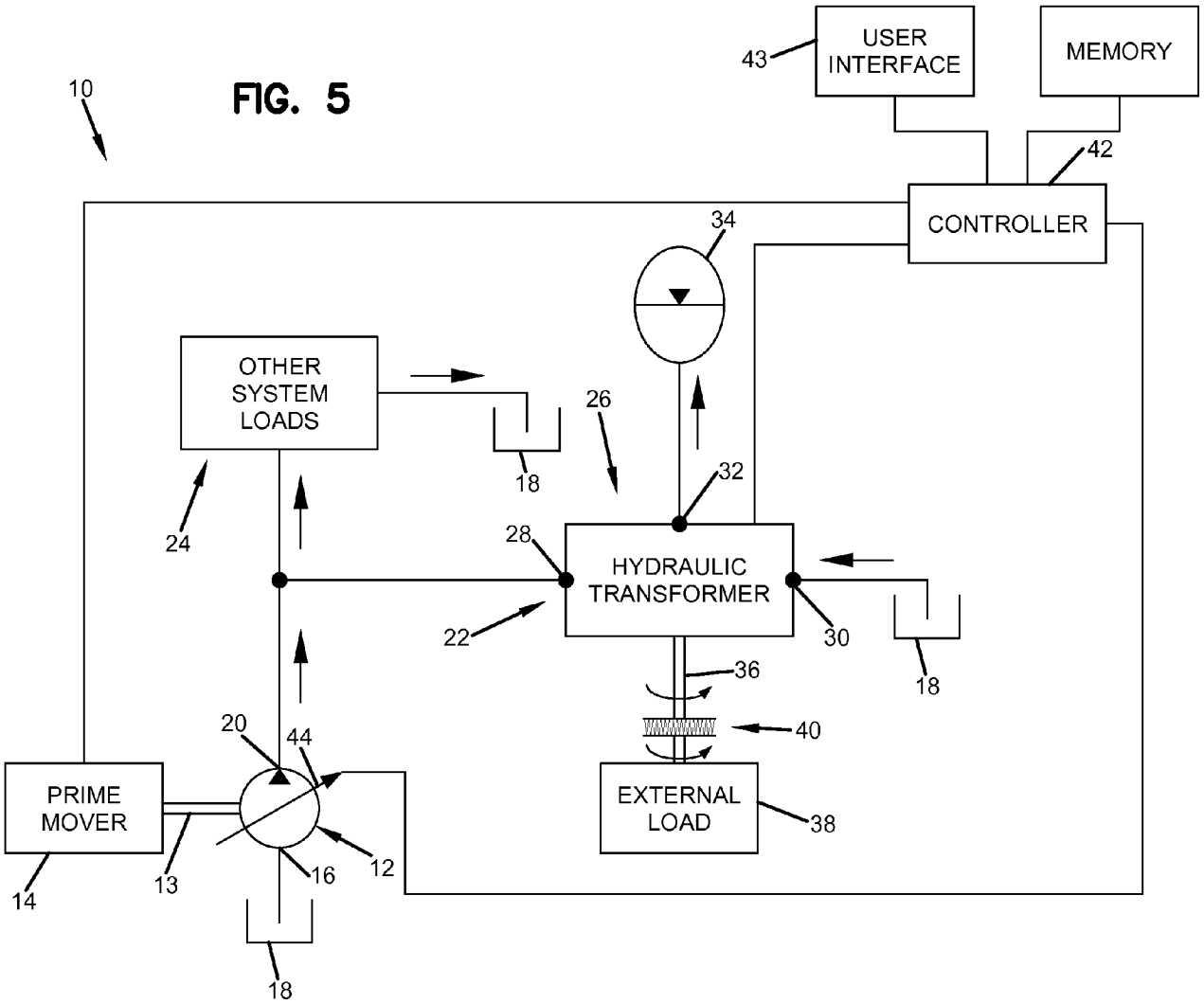

Box 68 of the matrix table 50 represents an operating mode/state where the prime mover 14 is under a low load and the transformer 26 is functioning as a pump in which torque is being transferred into the transformer 26 through the output/input shaft 36. The system 10 operates in this mode/state when the electronic controller 42 receives a command from the operator interface 43 instructing the electronic controller 42 to decelerate rotation of the external load 38. This creates an overrunning condition in which energy corresponding to the movement of the external load 38 (e.g., inertial energy) is converted into torque and transferred into the transformer 26 through the output/input shaft 36. In this condition, the electronic controller 42 controls the transformer 26 such that the transformer 26 provides a pumping function that converts the torque derived from the inertial energy of the external load 38 into hydraulic energy which is used to charge the accumulator 34 (see FIG. 5). As energy is transferred to the accumulator 34, the transformer 26 functions to brake rotation of the output/input shaft 36 to achieve the desired deceleration. In this mode/state, the electronic controller 42 can also control the transformer 26 such that excess energy from the variable displacement pump 12 is concurrently used to charge the accumulator 34.

Figure 6:
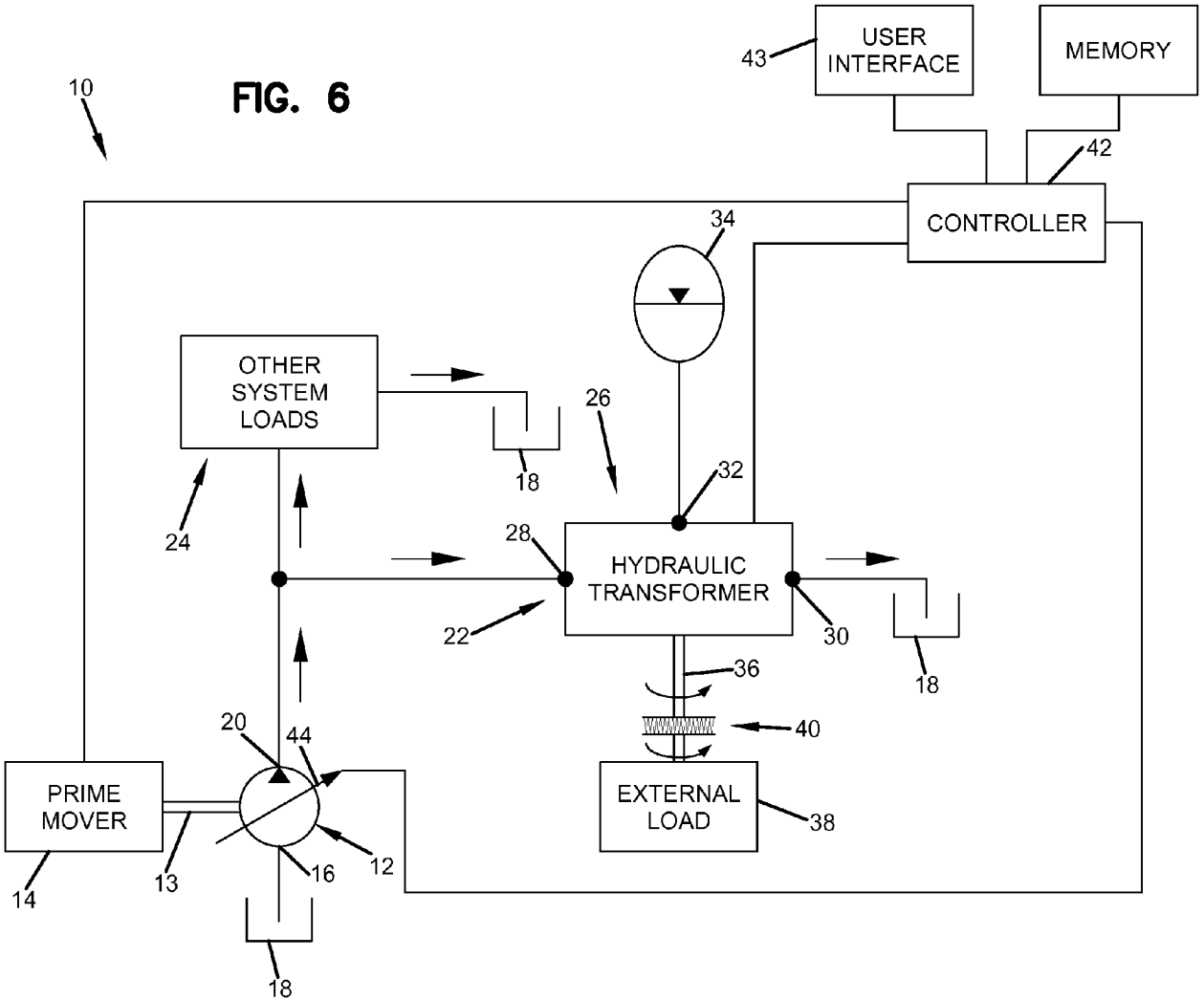

Box 70 of the matrix table 50 represents a mode/state where the prime mover 14 is operating at a target load and the hydraulic transformer 26 is providing a motoring function in which the output/input shaft 36 drives the external load 38. In this mode/state, the electronic controller 42 controls the transformer 26 such that energy from the variable displacement pump 12 is used to drive the output/input shaft 36 and no energy is transferred to the accumulator 34 (see FIG. 6).

Figure 7:
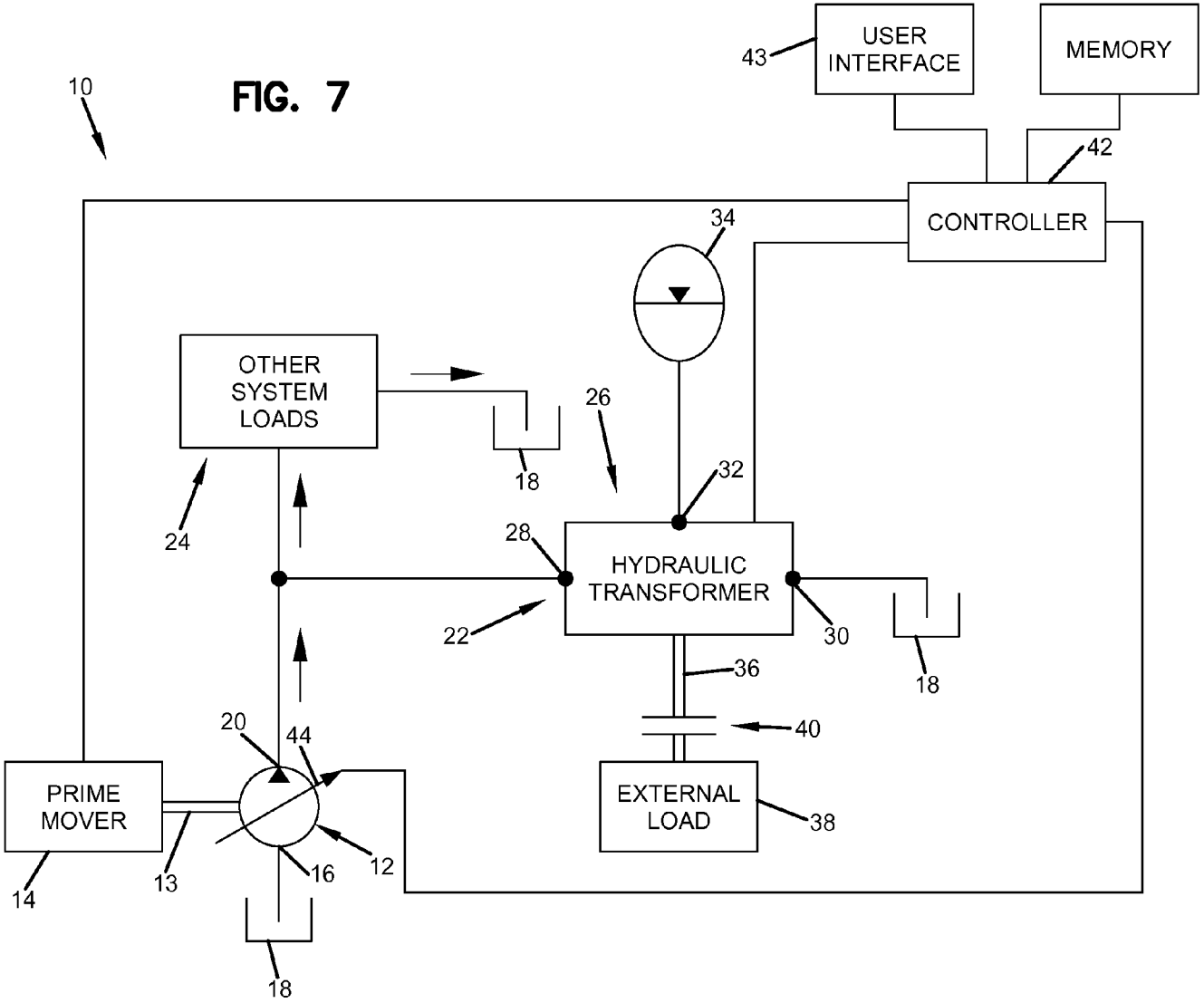

Box 72 represents a mode/state where the prime mover 14 is at a target load and the output/input shaft 36 is disengaged from the external load 38. In this mode/state, the electronic controller 42 controls the transformer 26 such that no energy is transferred through the hydraulic transformer 26 (see FIG. 7).

Figure 8:
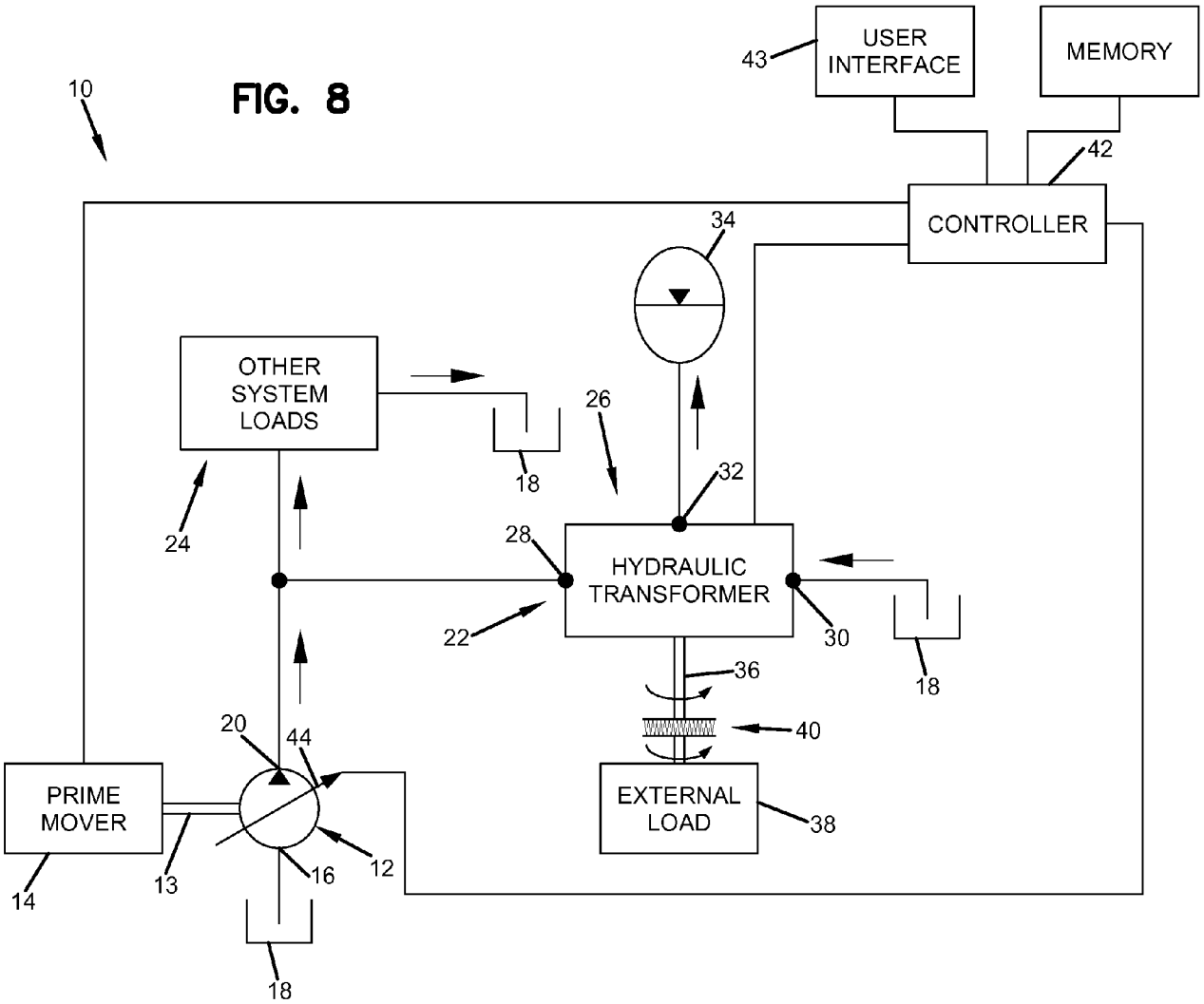

Box 74 of the matrix table 50 is representative of a mode/state where the prime mover 14 is at a target load and the transformer 26 is functioning as a pump in which torque is being transferred into the transformer 26 through the output/input shaft 36. The system 10 operates in this mode/state when the electronic controller 42 receives a command from the operator interface 43 instructing the electronic controller 42 to decelerate rotation of the external load 38. This creates an overrunning condition in which energy corresponding to the movement of the external load 38 (e.g., inertial energy) is converted into torque and transferred into the transformer 26 through the output/input shaft 36. In this mode/state, the electronic controller 42 controls the transformer 26 such that the transformer 26 provides a pumping function that converts the torque derived from the inertial energy of the external load 38 into hydraulic energy which is used to charge the accumulator 34 (see FIG. 8). As energy is transferred to the accumulator 34, the transformer 26 functions to brake rotation of the output/input shaft 36 to achieve the desired deceleration.

Figure 9:
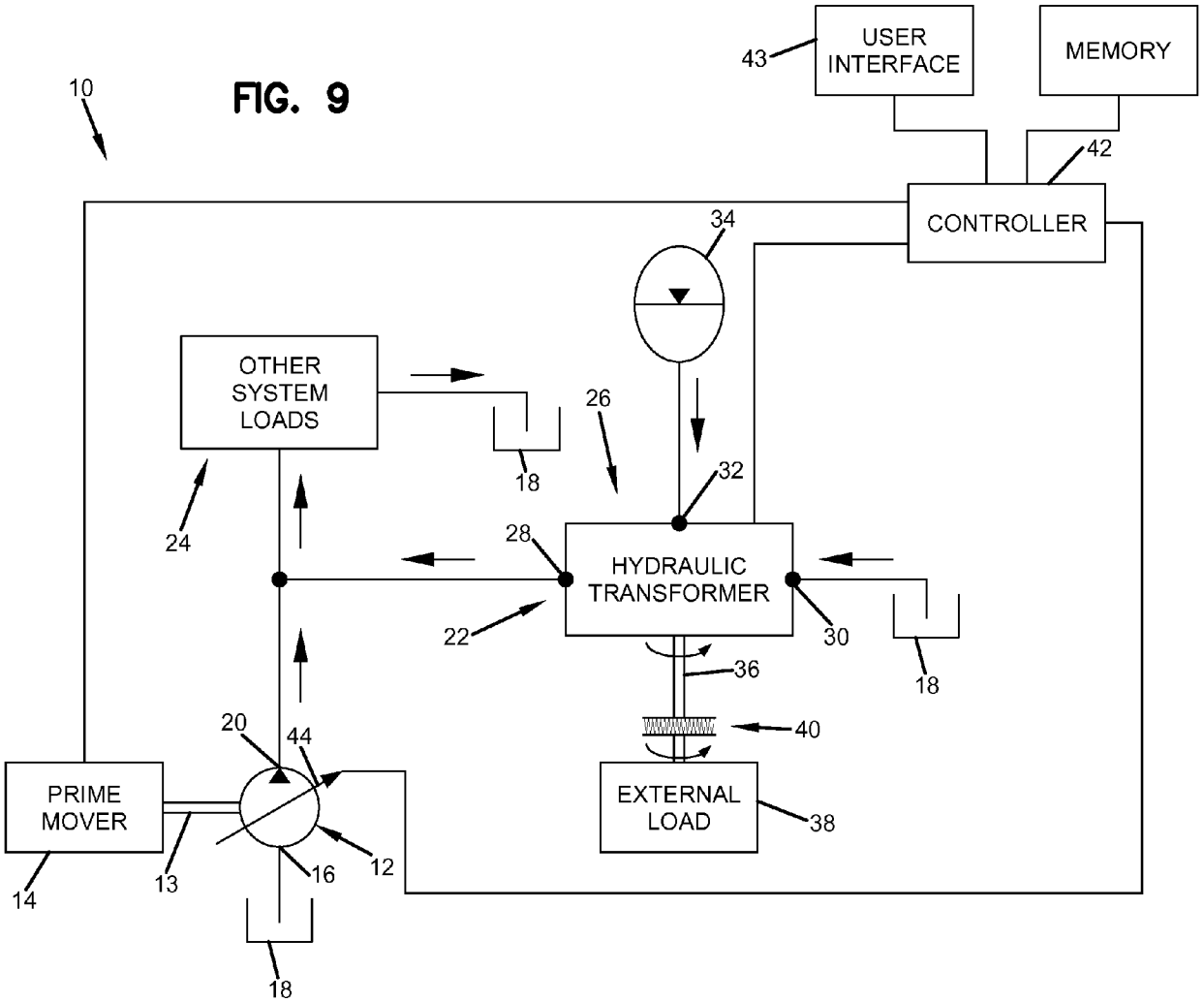

Box 76 of the matrix table 50 is representative of an operating mode/state where the prime mover 14 is operating under a high load and the transformer 26 provides motoring function in which the output/input shaft 36 drives the external load 38. In this mode/state, the controller 42 controls the transformer 26 such that energy from the accumulator 34 is used to rotate the output/input shaft 36 for driving the external load 38. Also, the transformer 26 is controlled by the controller 42 such that excess energy from the accumulator 34 can be concurrently transferred back toward the variable displacement pump 12 and the second load circuit 24 (see FIG. 9) to assist in leveling/reducing the load on the prime mover 14.

Figure 10:
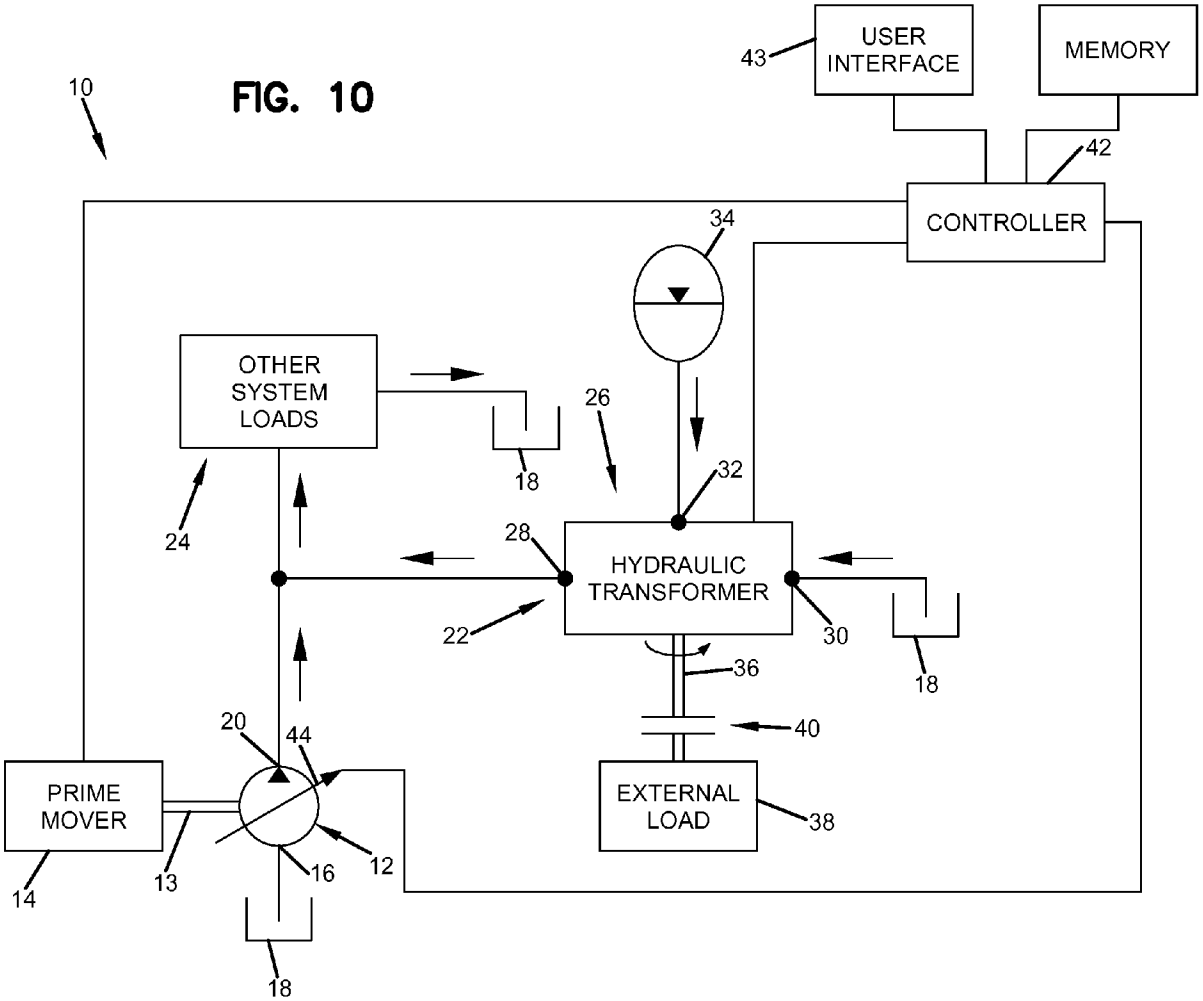

Box 78 of the matrix table 50 is representative of an operating mode/state where the prime mover 14 is operating under a high load condition and the output/input shaft 36 is disconnected from the external load 38. In this condition, the electronic controller 42 controls the transformer 26 such that energy from the accumulator 34 is directed through the hydraulic transformer 26 back toward the pump 12 and the second load circuit 24 for use at the second load circuit 24 (see FIG. 10) to assist in leveling/reducing the load on the prime mover 14. It will be appreciated that the pump 12 and the second load circuit 24 can be referred to as the "system side" of the overall hydraulic system 10.

Figure 11:
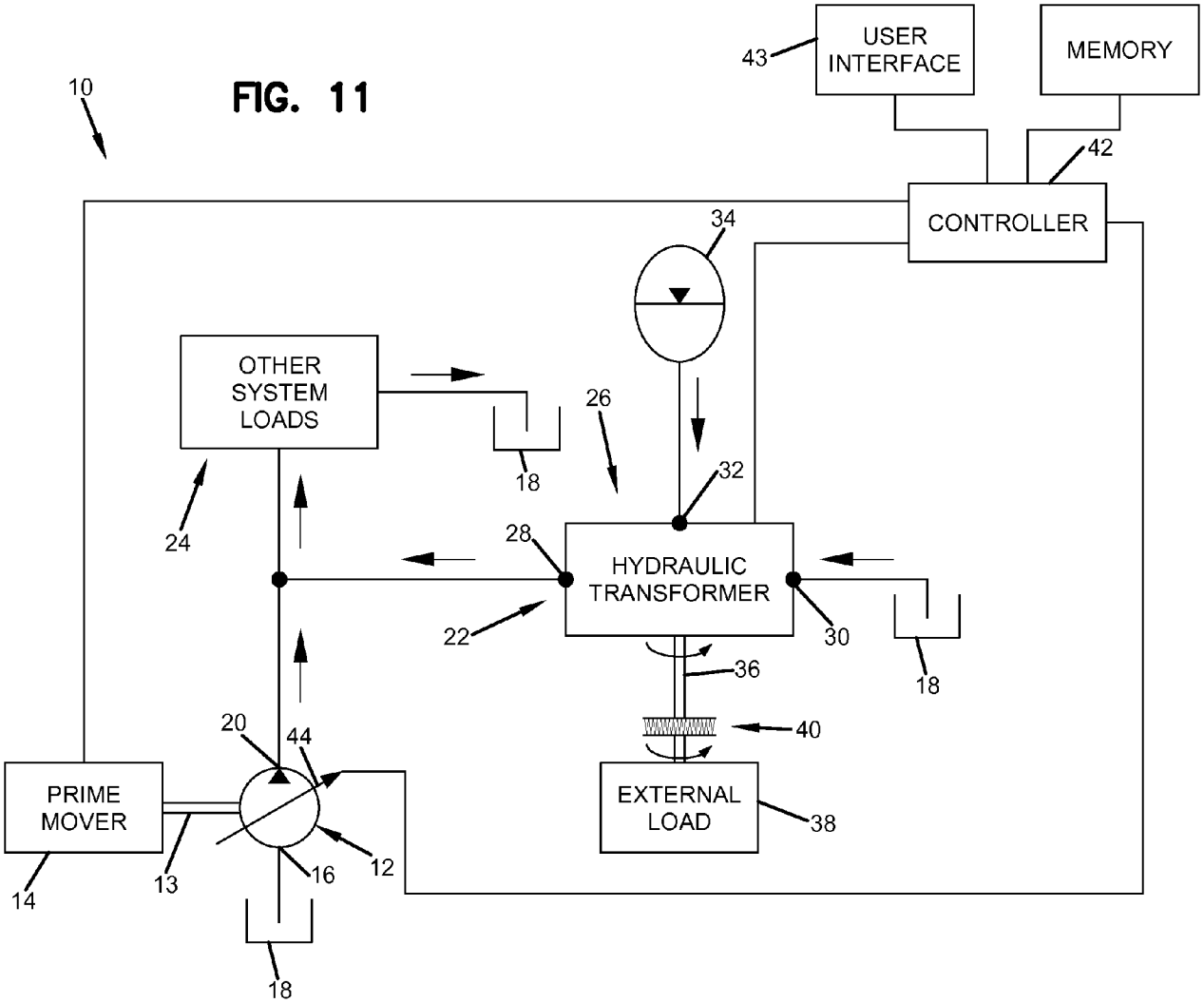

Box 80 of the matrix table 50 is representative of an operating mode/state where the prime mover 14 operating under a high load and the transformer 26 is functioning as a pump in which torque is being transferred into the transformer 26 through the output/input shaft 36. The system 10 operates in this mode/state when the electronic controller 42 receives a command from the operator interface 43 instructing the electronic controller 42 to decelerate rotation of the external load 38. This creates an overrunning condition in which energy corresponding to the movement of the external load 38 (e.g., inertial energy) is converted into torque and transferred into the transformer 26 through the output/input shaft 36. In this mode/state, the electronic controller 42 controls the transformer 26 such that the transformer 26 provides a pumping function that converts the torque derived from the inertial energy of the external load 38 into hydraulic energy which is directed toward the system side of the hydraulic system 10 and used to assist in leveling/reducing the load on the prime mover 14. As energy is transferred to the system side, the transformer 26 functions to brake rotation of the output/input shaft 36 to achieve the desired deceleration. In this condition, the electronic controller 42 can also control the transformer 26 such that energy from the accumulator 34 is concurrently directed back toward the system side of the overall hydraulic system 10 and the second load circuit 24 for use at the second load circuit 24 (see FIG. 11).

Figure 13:
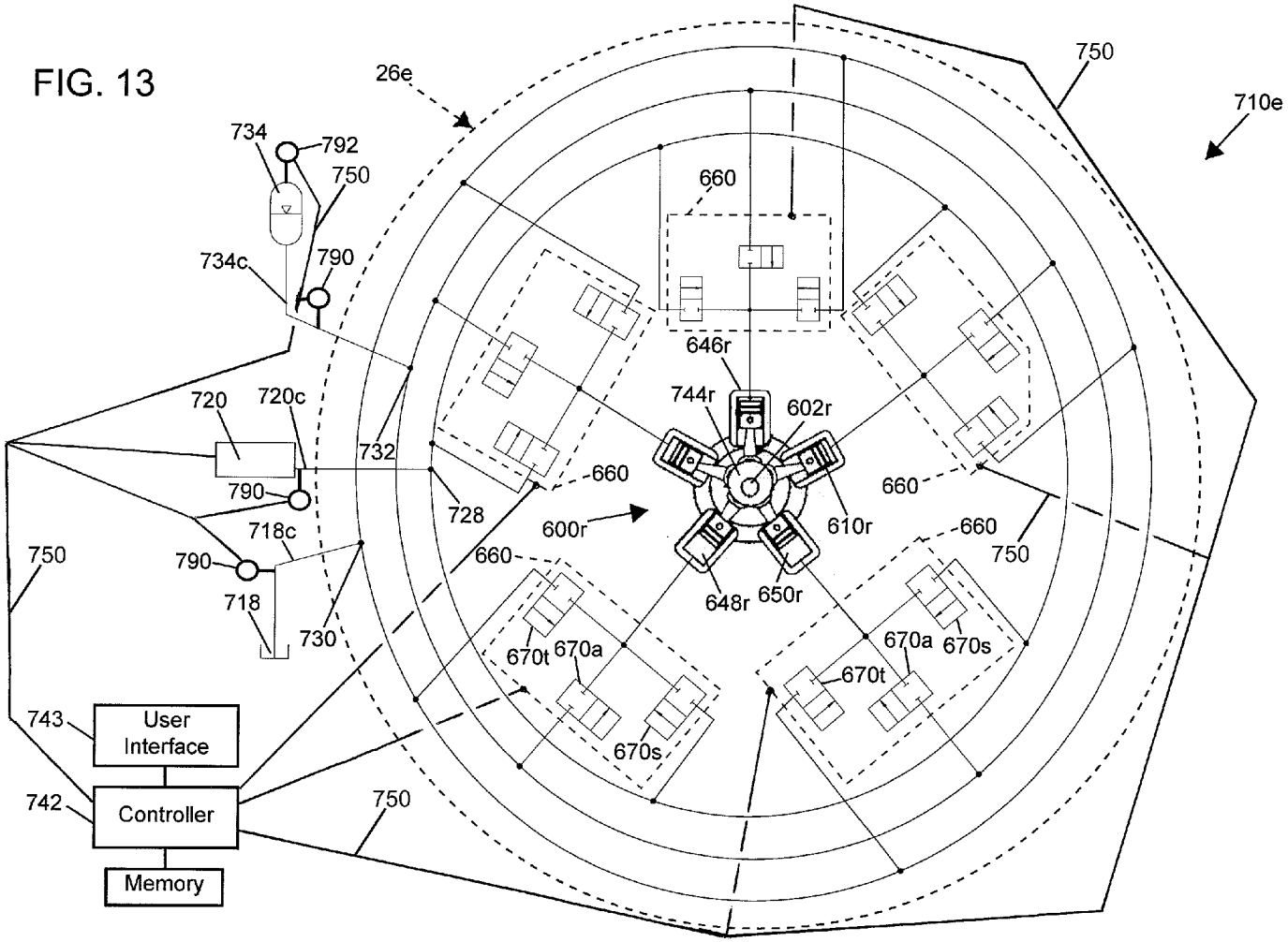
FIG. 13 is a schematic diagram of a third hydraulic system in accordance with the principles of the present disclosure.
Figure 14:
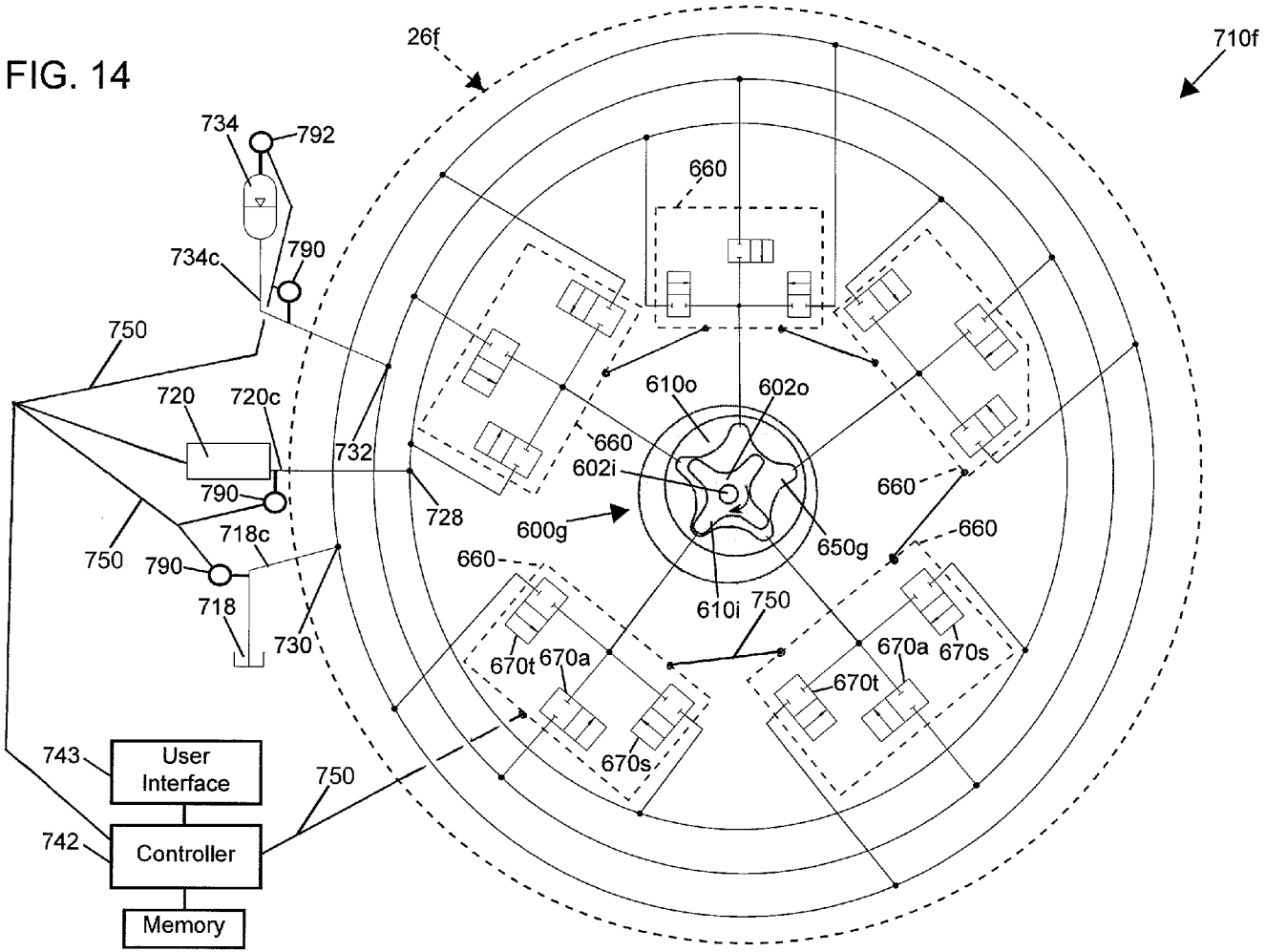
FIG. 14 is a schematic diagram of a fourth hydraulic system in accordance with the principles of the present disclosure.

The hydraulic transformer 26 can include two rotating groups and in this way be similar to a conventional hydraulic transformer. U.S. provisional patent application Ser. No. 61/523,099, filed Aug. 12, 2011, entitled System and Method for Recovering Energy and Leveling Hydraulic System Loads, and hereby incorporated by reference in its entirety, discloses a hydraulic transformer (e.g., hydraulic transformer 26*a* at FIGS. 12-21) having a plurality of pump/motor units (i.e., rotating groups) connected by a common shaft. As will be described in detail below, the hydraulic transformer 26, illustrated at FIGS. 1 and 3-11, can alternatively include a single rotating group and a plurality of valve sets. Schematic examples of the hydraulic transformer 26 with a single rotating group and a plurality of valve sets are illustrated at FIGS. 12-14.

Figure 12:
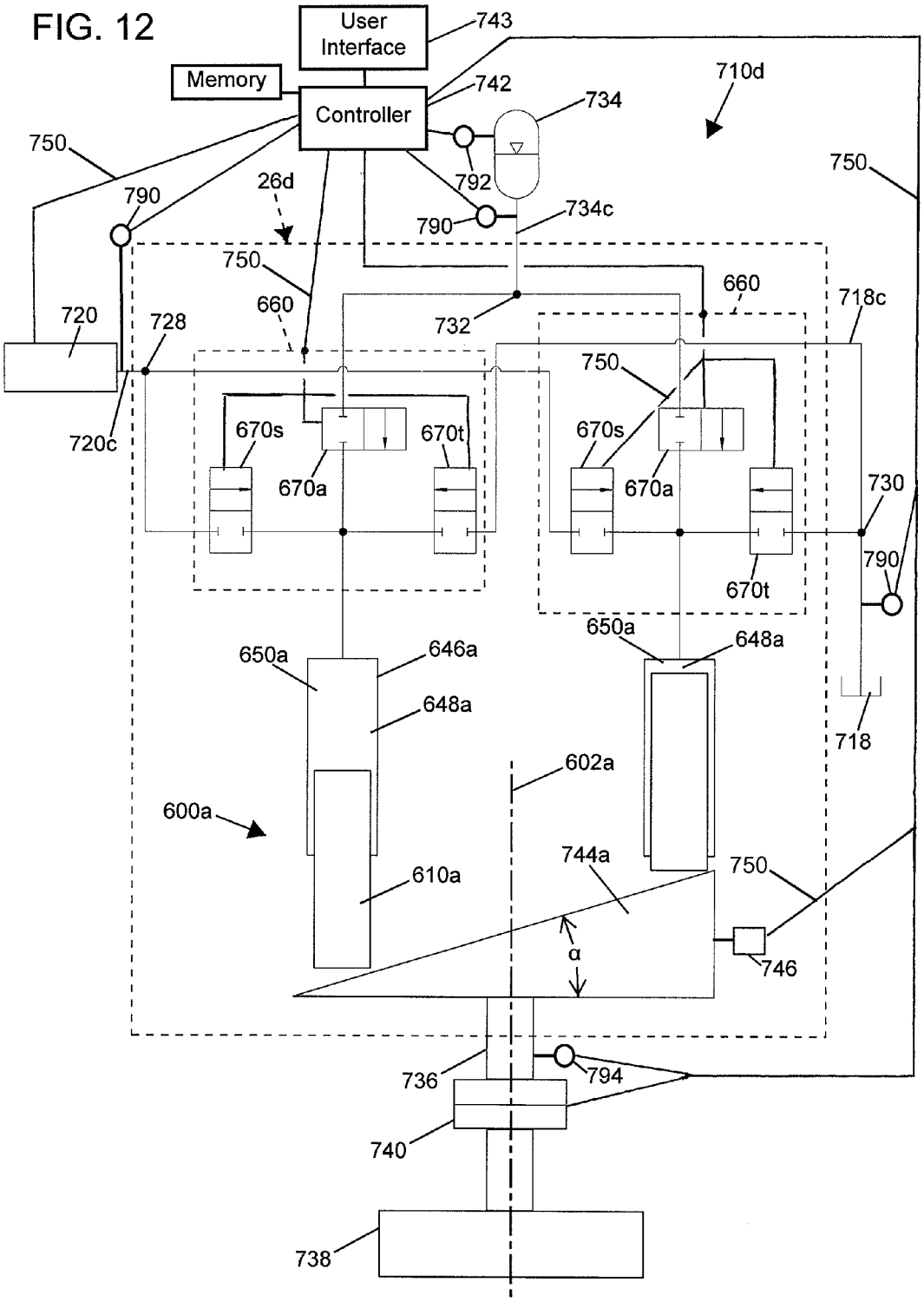
FIG. 12 is a schematic diagram of a second hydraulic system in accordance with the principles of the present disclosure.
Figure 15:
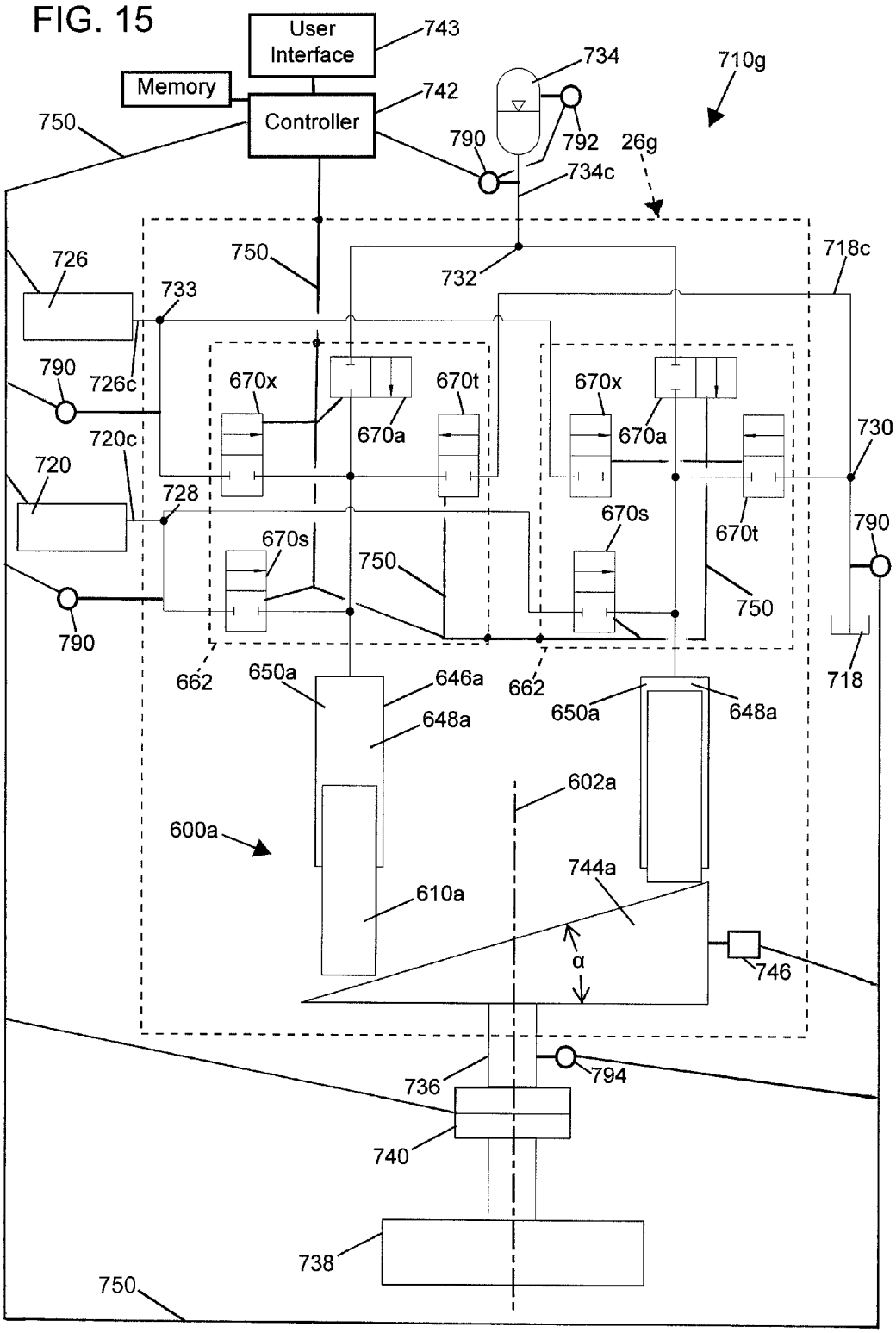
FIG. 15 is a schematic diagram of a fifth hydraulic system in accordance with the principles of the present disclosure.

In particular, FIG. 12 illustrates a hydraulic transformer 26*d* with a single rotating group 600*a* wherein the single rotating group 600*a* is an axial rotating group (i.e., pistons 610*a* of the single rotating group 600*a* reciprocate parallel to a rotational axis 602*a* of the single rotating group 600*a*). FIG. 13 illustrates a hydraulic transformer 26*e* with a single rotating group 600*r* wherein the single rotating group 600*r* is a radial rotating group (i.e., pistons 610*r* of the single rotating group 600*r* reciprocate radially to a rotational axis 602*r* of the single rotating group 600*r*). FIG. 14 illustrates a hydraulic transformer 26*f* with a single rotating group 600*g* wherein the single rotating group 600*g* is a gerotor rotating group (i.e., an inner rotor 610*i* of the single rotating group 600*g* rotates about a rotational axis 602*i* within an outer rotor 610*o* of the single rotating group 600*g* that rotates about a rotational axis 602*o* of the single rotating group 600*r*). FIG. 15 illustrates a hydraulic transformer 26*g* with the single rotating group 600*a*. The hydraulic transformer 26*g* is an example hydraulic transformer that includes an additional valve set in comparison with the hydraulic transformer 26*d*. The additional valve set provides the hydraulic transformer 26*g* with added functionality, as will be described in detail below. Such an additional valve set could likewise be included with the hydraulic transformers 26*e*, 26*f*, and similar hydraulic transformers.

Hereinafter, the single rotating groups 600*a*, 600*r*, 600*g*, and other rotating groups may collectively be referred to as rotating groups 600. The rotating groups 600 may include other rotating group arrangements and configurations in addition to axial, radial, and gerotor. As depicted, the rotating groups 600 have a positive displacement and are similar to certain related positive displacement pump/motor units. In certain embodiments, the rotating groups 600 may be fixed displacement rotating groups. In other embodiments, the rotating groups 600 may be variable displacement rotating groups. As used in this paragraph, the terms "positive displacement", "fixed displacement", and "variable displacement" refer to the physical geometry and characteristics of the rotating group 600 when used in a conventional pump/motor unit. As will be described in detail below, the hydraulic transformer 26, with a single rotating group 600, may function as a variable displacement rotating group (e.g., a variable displacement pump/motor unit) by selective use of the plurality of valve sets even if the rotating group 600 is a "fixed displacement" rotating group.

As depicted, the hydraulic transformers 26*d*, 26*e*, 26*f*, and 26*g* include the single rotating groups 600*a*, 600*r*, 600*g*, and 600*a*, respectively. The single rotating groups 600*a*, 600*r*, and 600*g* provide the hydraulic transformer 26 benefits including mechanical simplicity, low cost, compactness, low rotational inertia, enhanced serviceability, minimal or no redundancy, efficient internal porting, etc. In other embodiments, the rotating group 600 of the hydraulic transformer 26 may include a plurality of rotating groups that similarly use a plurality of valve sets as illustrated with the hydraulic transformers 26*d*, 26*e*, 26*f*, and 26*g*.

As mentioned above, the hydraulic transformers 26*d*, 26*e*, and 26*f* are suitable for use as the hydraulic transformer 26 of the first load circuit 22 of the system 10, illustrated at FIGS. 1 and 3-11. As will be described in detail below, the hydraulic transformer 26*g* is suitable as a replacement for the hydraulic transformer illustrated at FIGS. 22 and 23 of U.S. provisional patent application Ser. No. 61/523,099, incorporated by reference above.

The hydraulic transformers 26*d*, 26*e*, 26*f*, and 26*g* will now be further described in context with systems 710*d*, 710*e*, 710*f*, and 710*g*, illustrated at FIGS. 12-15, respectively. Each of the systems 710*d*, 710*e*, 710*f*, and 710*g* may include a tank 718 (i.e., a low pressure hydraulic fluid reservoir), a supply 720 (i.e., a high pressure hydraulic fluid supply), a hydraulic accumulator 734, a controller 742, and a user interface 743. The tank 718 is fluidly connected to the hydraulic transformers 26*d*, 26*e*, 26*f*, and 26*g* by a tank line 718*c* that may branch as needed. The supply 720 is fluidly connected to the hydraulic transformers 26*d*, 26*e*, 26*f*, and 26*g* by a supply line 720*c* that may branch as needed. And, the accumulator 734 is fluidly connected to the hydraulic transformers 26*d*, 26*e*, 26*f*, and 26*g* by an accumulator line 734*c* that may branch as needed. The system 710*g* further includes an auxiliary hydraulic load/supply 726. The auxiliary hydraulic load/supply 726 is fluidly connected to the hydraulic transformer 26*g* by an auxiliary line 726*c* that may branch as needed. The hydraulic transformers 26*d*, 26*e*, 26*f*, and 26*g* may fluidly connect at a first port 728, a second port 730, and a third port 732. In particular, the first port 728 may fluidly connect to the supply 720, the second port 730 may fluidly connect to the tank 718, and the third port 732 may fluidly connect to the accumulator 734. The hydraulic transformer 26*g* may further fluidly connect at a fourth port 733 that may fluidly connect to the auxiliary hydraulic load/supply 726. In other embodiments, the hydraulic transformers 26*d*, 26*e*, 26*f*, and 26*g* may connect to other elements and/or may not necessarily connect to a tank, a supply, an accumulator, and/or an auxiliary hydraulic load/supply.

As depicted at FIGS. 1, 3-12, and 15, the hydraulic transformers 26, 26*d*, 26*e*, 26*f*, and 26*g* may further include the output/input shaft 36 or an output/input shaft 736 that couples to the external load 38 or an external load 738. The clutch 40 or a clutch 740 can be used to selectively engage the output/input shaft 36, 736 with the external load 38, 738 and disengage the output/input shaft 36, 736 from the external load 38, 738. When the clutch 40, 740 engages the output/input shaft 36, 736 with the external load 38, 738, torque is transferred between the output/input shaft 36, 736 and the external load 38, 738. In contrast, when the clutch 40, 740 disengages the output/input shaft 36, 736 from the external load 38, 738, no torque is transferred between the output/input shaft 36, 736 and the external load 38, 738. Gear reductions can be provided between the clutch 40, 740 and the external load 38, 738. The output/input shaft 36, 736 may mechanically connect to a swashplate 744*a* (i.e., a wobble plate) of the rotating group 600*a* as illustrated at FIGS. 12 and 15. Alternatively, the output/input shaft 36, 736 may mechanically connect to a cylinder housing 646*a* of the rotating group 600*a*. The output/input shaft 36, 736 may mechanically connect to a crankshaft 744*r* of the rotating group 600*r*. Alternatively, the output/input shaft 36, 736 may mechanically connect to a cylinder housing 646*r* of the rotating group 600*r*. The output/input shaft 36, 736 may mechanically connect to the inner rotor 610*i* of the rotating group 600*g*. Alternatively, the output/input shaft 36, 736 may mechanically connect to the outer rotor 610*o* of the rotating group 600*g*. In certain embodiments, the hydraulic transformers 26, 26*d*, 26*e*, 26*f*, and 26*g* may not necessarily include an output/input shaft and/or a clutch and/or may not necessarily connect to an external load.

As depicted at FIGS. 12 and 15, the rotating group 600*a* includes two fluid chambers 650*a* that expand and contract in volume accompanied by relative rotational movement 806 between the cylinder housing 646*a* and the swashplate 744*a* (see FIGS. 16-23). In other embodiments, there may be more than two of the fluid chambers 650*a*. In still other embodiments, there may be a single fluid chamber 650*a*. The swashplate 744*a* may be fixed (i.e., with a fixed angle $\alpha$) or variable (i.e., with a variable angle $\alpha$). A volume of hydraulic fluid displaced across the rotating group 600*a* per revolution of the relative rotational movement 806 can be varied by varying the angle $\alpha$ of the swashplate 744*a*. When the swashplate 744*a* is angled relative to the shaft 736 (i.e., the angle $\alpha$ of the swashplate 744*a* is non-zero), hydraulic fluid flow is directed through the rotating group 600*a* by the action of the reciprocating pistons 610*a*. The swashplate 744*a* can be an over-the-center swashplate that allows for bi-directional rotation of the relative rotational movement 806 relative to hydraulic fluid flow direction. When the swashplate 744*a* is aligned perpendicular to the shaft 736 (i.e., the angle $\alpha$ of the swashplate 744*a* is zero), no hydraulic fluid flow is directed through the rotating group 600*a*. In embodiments with the variable swashplate 744*a*, the variable angle $\alpha$ may be controlled by a swashplate actuator 746. The pistons 610*a* reciprocate within cylinders 648*a* of the cylinder housing 646*a* and thereby cause the volume of each of the fluid chambers 650*a* to alternately expand and contract. The relative rotational movement 806 between the cylinder housing 646*a* and the swashplate 744*a* may drive hydraulic fluid into and out of the fluid chambers 650*a* (e.g. a pumping action), and/or hydraulic fluid pressure may drive the relative rotational movement 806 between the cylinder housing 646*a* and the swashplate 744*a* (e.g., a motoring action). The relative rotational movement 806 between the cylinder housing 646*a* and the swashplate 744*a* may result from or may cause inflow 802 of the hydraulic fluid into the rotating group 600*a* (see FIGS. 16-23), and/or the relative rotational movement 806 between the cylinder housing 646*a* and the swashplate 744*a* may result from or may cause outflow 804 of the hydraulic fluid from the rotating group 600*a* (see FIGS. 16-23).

As depicted at FIG. 13, the rotating group 600*r* includes five fluid chambers 650*r* that expand and contract in volume accompanied by the relative rotational movement 806 (see FIGS. 16-23) between the cylinder housing 646*r* and the crankshaft 744*r*. In other embodiments, there may be more than five of the fluid chambers 650*r*. In still other embodiments, there may be fewer than five of the fluid chambers 650*r*. The pistons 610*r* reciprocate within cylinders 648*r* of the cylinder housing 646*r* and thereby cause the volume of each of the fluid chambers 650*r* to alternately expand and contract. The relative rotational movement 806 between the cylinder housing 646*r* and the crankshaft 744*r* may drive hydraulic fluid into and out of the fluid chambers 650*r* (e.g. a pumping action), and/or hydraulic fluid pressure may drive the relative rotational movement 806 between the cylinder housing 646*r* and the crankshaft 744*r* (e.g., a motoring action). The relative rotational movement 806 between the cylinder housing 646*r* and the crankshaft 744*r* may result from or may cause the inflow 802 of the hydraulic fluid into the rotating group 600*r* (see FIGS. 16-23), and/or the relative rotational movement 806 between the cylinder housing 646*r* and the crankshaft 744*r* may result from or may cause the outflow 804 of the hydraulic fluid from the rotating group 600*r* (see FIGS. 16-23).

As depicted at FIG. 14, the rotating group 600*g* includes five fluid chambers 650*g* that expand and contract in volume accompanied by the relative rotational movement 806 (see FIGS. 16-23) between the inner rotor 610*i* and the outer rotor 610*o*. In other embodiments, there may be more than five of the fluid chambers 650*g*. In still other embodiments, there may be fewer than five of the fluid chambers 650*g*. The inner rotor 610*i* cycles within the outer rotor 610*o* and thereby causes the volume of each of the fluid chambers 650*g* to alternately expand and contract. The relative rotational movement 806 between the inner rotor 610*i* and the outer rotor 610*o* may drive hydraulic fluid into and out of the fluid chambers 650*g* (e.g. a pumping action), and/or hydraulic fluid pressure may drive the relative rotational movement 806 between the inner rotor 610*i* and the outer rotor 610*o* (e.g., a motoring action). The relative rotational movement 806 between the inner rotor 610*i* and the outer rotor 610*o* may result from or may cause the inflow 802 of the hydraulic fluid into the rotating group 600*g* (see FIGS. 16-23), and/or the relative rotational movement 806 between the inner rotor 610*i* and the outer rotor 610*o* may result from or may cause the outflow 804 of the hydraulic fluid from the rotating group 600*g* (see FIGS. 16-23).

In general, the rotating groups 600, including the rotating groups 600*a*, 600*r*, 600*g*, and the other rotating groups, include fluid chambers, including the fluid chambers 650*a*, 650*r*, 650*g*, and other fluid chambers. Herein, the fluid chambers 650*a*, 650*r*, 650*g*, and the other fluid chambers will be collectively referred to as fluid chambers 650. In general, the rotating groups 600 include one or more of the fluid chambers 650 that expand and contract in volume accompanied by the relative rotational movement 806 (see FIGS. 16-23). The relative rotational movement 806 may drive hydraulic fluid into and out of the fluid chambers 650 (e.g. a pumping action), and/or hydraulic fluid pressure may drive the relative rotational movement 806 (e.g., a motoring action). The relative rotational movement 806 may result from or may cause the inflow 802 of the hydraulic fluid into the rotating group 600 (see FIGS. 16-23), and/or the relative rotational movement 806 may result from or may cause the outflow 804 of the hydraulic fluid from the rotating group 600*g* (see FIGS. 16-23).

As depicted at FIG. 12, the hydraulic transformer 26*d* includes a plurality of valve sets 660 with one of the valve sets 660 fluidly connected to each of the fluid chambers 650*a*. In the depicted embodiments, each of the valve sets 660 includes a supply valve 670*s*, an accumulator valve 670*a*, and a tank valve 670*t*. As depicted at FIG. 13, the hydraulic transformer 26*e* includes a plurality of the valve sets 660 with one of the valve sets 660 fluidly connected to each of the fluid chambers 650*r*. As depicted at FIG. 14, the hydraulic transformer 26*f* includes a plurality of the valve sets 660 with one of the valve sets 660 fluidly connected to each of the fluid chambers 650*g*. As depicted at FIG. 15, the hydraulic transformer 26*g* includes a plurality of valve sets 662 with one of the valve sets 662 fluidly connected to each of the fluid chambers 650*a*. In the depicted embodiment, each of the valve sets 662 includes the supply valve 670*s*, the accumulator valve 670*a*, the tank valve 670*t*, and an auxiliary valve 670*x*. In general, the hydraulic transformer 26, including the hydraulic transformer 26 with a single rotating group 600, may include a plurality of the valve sets 660, 662 with one of the valve sets 660, 662 fluidly connected to each of the fluid chambers 650.

As depicted at FIGS. 12-15, each of the supply valves 670*s* selectively connects its respective one of the fluid chambers 650, 650*a*, 650*r*, 650*g* to the supply 720. Each of the accumulator valves 670*a* selectively connects its respective one of the fluid chambers 650, 650*a*, 650*r*, 650*g* to the hydraulic accumulator 734. And, each of the tank valves 670*t* selectively connects its respective one of the fluid chambers 650, 650*a*, 650*r*, 650*g* to the tank 718. As depicted at FIG. 15, each of the auxiliary valves 670*x* selectively connects its respective one of the fluid chambers 650, 650*a* to the auxiliary hydraulic load/supply 726. In other embodiments, the auxiliary valve 670*x* can be included in the valve sets 660 and thereby selectively connect its respective one of the fluid chambers 650, 650*r*, 650*g* to the auxiliary hydraulic load/supply 726. In other embodiments, one or more additional valves (e.g., additional auxiliary valves) can be included in the valve sets 660, 662 and thereby selectively connect its/their respective one of the fluid chambers 650, 650*a*, 650*r*, 650*g* to one or more additional hydraulic loads/supplies, respectively.

As depicted at FIGS. 12-15, the supply valves 670*s*, the accumulator valves 670*a*, the tank valves 670*t*, and the auxiliary valves 670*x* are two port—two position valves. Hereinafter, the supply valves 670*s*, the accumulator valves 670*a*, the tank valves 670*t*, the auxiliary valves 670*x*, and the additional valves may collectively be referred to as valves 670. In an open position of the valves 670, the two ports of each of the valves 670 are fluidly connected to each other, and hydraulic fluid is free to flow between the connected two ports. In preferred embodiments, some or all of the valves 670 allow the hydraulic fluid to flow freely in both directions between the two ports when the valves 670 are in the open position. In a closed position of the valves 670, the two ports of each of the valves 670 are fluidly disconnected from each other, and the hydraulic fluid is substantially prevented from flowing between the two ports of the valve 670. In certain embodiments, some or all of the valves 670 have substantially only the two positions and do not substantially throttle (i.e., feather) flow of the hydraulic fluid.

The valves 670 of the depicted embodiments are electrically actuated by a control signal. The valves 670 of the depicted embodiments are digitally controlled by a digital control signal. The valves 670 may respond to a first value (e.g., zero volts or zero milliamperes or below 2.5 volts or below 100 milliamperes) by moving quickly to or staying at the closed position and to a second value (e.g., 5 volts or 200 milliamperes or above 2.5 volts or above 100 milliamperes) by moving quickly to or staying at the open position.

The valves 670 of the depicted embodiments are high-speed valves that may move from the open position to the closed position in as little as 0.5 millisecond, from the closed position to the open position in as little as 0.5 millisecond, from the open position to the closed position and then back to the open position in as little as 1 millisecond, and from the closed position to the open position and then back to the closed position in as little as 1 millisecond. The rotating group 600 may have a rotational period of as fast as 20 milliseconds (equivalent to 3,000 revolutions per minute). Thus, a ratio of the open-closed-open period of the valves 670 to the rotational period of the rotating group 600 is about 1/20, and a ratio of the closed-open-closed period of the valves 670 to the rotational period of the rotating group 600 is about 1/20. In certain embodiments, such ratios between the period of the valves 670 and the rotational period of the rotating group 600 range from about 1/5 to about 1/50.

The valves 670 may be operated at a frequency when activated. In certain embodiments, the frequency of the valves 670 may be as high as 1,000 Hertz. The rotating group 600 may have a rotational frequency of as fast as 50 Hertz (equivalent to 3,000 revolutions per minute). Thus, a ratio of the frequency of the valves 670 and the rotational frequency of the rotating group 600 is about 20. In certain embodiments, such ratios between the frequency of the valves 670 and the rotational frequency of the rotating group 600 range from about 5 to about 50.

In certain embodiments (e.g., larger displacement embodiments compared with the preceding two paragraphs), the valves 670 of the depicted embodiments are high-speed valves that may move from the open position to the closed position in as little as 4 milliseconds, from the closed position to the open position in as little as 3 milliseconds, from the open position to the closed position and then back to the open position in as little as 7 milliseconds, and from the closed position to the open position and then back to the closed position in as little as 7 milliseconds. The rotating group 600 may have a rotational period of as fast as 67 milliseconds (equivalent to 900 revolutions per minute). Thus, a ratio of the open-closed-open period of the valves 670 to the rotational period of the rotating group 600 is about 1/10, and a ratio of the closed-open-closed period of the valves 670 to the rotational period of the rotating group 600 is about 1/10. The valves 670 may be operated at a frequency when activated. In certain embodiments, the frequency of the valves 670 may be as high as 150 Hertz. The rotating group 600 may have a rotational frequency of as fast as 15 Hertz (equivalent to 900 revolutions per minute). Thus, a ratio of the frequency of the valves 670 and the rotational frequency of the rotating group 600 is about 10.

In certain embodiments, each of the valves 670 may be controlled by a pulse width modulated signal (i.e., a PWM signal). The pulse width modulated signal may include a duty cycle that ranges between 0 percent and 100 percent. The valve 670 may be controlled by the duty cycle of the pulse width modulated signal. In certain embodiments, each of the pulse width modulated signals may be dedicated to one of the valves 670. In certain embodiments, each of the pulse width modulated signals may be shared by two of the valves 670 or more than two of the valves 670. The two of the valves 670 sharing the pulse width modulated signal may have an inverted signal to valve position relationship (e.g., a high signal may close one and open the other valve 670 and a low signal may open the one and close the other valve 670). All of the valves 670 in a given hydraulic transformer 26, 26*d*, 26*e*, 26*f*, or 26*g* may be synchronized at the same frequency and have their duty cycles coordinated.

The valves 670 of the depicted embodiments are illustrated as being individual two position valves. In other embodiments, one or more of the valves 670 in a given hydraulic transformer 26, 26*d*, 26*e*, 26*f*, or 26*g* may be grouped together on a common valve block. As an example, the valves 670 of one of the valve sets 660, 662 may be grouped together. As another example, the valves 670 connected to a given port 728, 730, 732, 733 (e.g., the tank valves 670*t*) may be grouped together. In other embodiments, one or more of the two position valves 670 may be replaced by a multi-position multi-port valve. Such multi-position multi-port valves may be grouped together on a common valve block. The valves 670 and/or their equivalents may be integrated with the rotating group 600 (e.g., the valves 670 may be integrated with and/or attached to the cylinder housing 646*a*, 646*r*).

Other example valves that may be suitable for use as the valves 670 are described and illustrated at US Patent Application Pub. No. US 2009/0123313 A1, U.S. Pat. No. 8,235,676, and U.S. Pat. No. 8,226,370, which are hereby incorporated by reference in their entireties.

As mentioned above and as depicted at FIGS. 1 and 3-15, the systems 10, 710*d*, 710*e*, 710*f*, and 710*g* may include the controller 42, 742 and the user interface 43, 743. In preferred embodiments, the controller 42, 742 is an electronic controller. In preferred embodiments, the controller 42, 742 is a computerized controller. In preferred embodiments, the controller 42, 742 receives input signals and generates output signals. In preferred embodiments, the controller 42, 742 stores system information in memory (e.g., RAM, ROM, etc.). In preferred embodiments, the controller 42, 742 may execute a control program and thereby control the system 10, 710*d*, 710*e*, 710*f*, and 710*g*.

The controller 42, 742 may be connected to a plurality of input devices (e.g., by a wiring harness 750) and thereby receive input signals from the input devices. The controller 42, 742 may be connected to a plurality of system components (e.g., by the wiring harness 750) and thereby send output signals to the system components. The controller 42, 742 may compute and/or calculate the output signals based upon the input signals. The input devices sending the input signals to the controller 42, 742 may include the prime mover 14, the pump 12, the user interface 43, 743, the swashplate 44, 744*a*, the valves 670*a*, 670*s*, 670*t*, 670*x*, the supply 720, the auxiliary hydraulic load/supply 726, one or more pressure sensors 790, one or more temperature sensors 792, and/or one or more motion sensors 794 (e.g., position sensors, rotational position sensors, speed sensors, rotational speed sensors, acceleration sensors, rotational acceleration sensors, etc.). The system components receiving the output signals from the controller 42, 742 may include the prime mover 14, the pump 12, the clutch 40, 740, the user interface 43, 743, the swashplate 44, 744*a* (i.e., the swashplate actuator 746), the valves 670*a*, 670*s*, 670*t*, 670*x*, the supply 720, and/or the auxiliary hydraulic load/supply 726.

According to the principles of the present disclosure, by controlling (e.g., rapidly controlling and/or individually controlling) the open/closed positions of each of the valves 670*a*, 670*s*, 670*t*, 670*x* of the valve sets 660, the controller 42, 742 can operate the system 10, 710*d*, 710*e*, 710*f*, 710*g* in a variety of operating modes including any one of the operating modes set forth in the matrix table 50 of FIG. 2. FIGS. 16-23 illustrate several examples of timing diagrams and power directional paths that the hydraulic transformer 26 and the system 10, 710*d*, 710*e*, 710*f*, 710*g* can be configured to.

Each of the FIGS. 16-23 includes a timing circle 820, a legend 822, and a flow schematic 824 that are related to each other at the illustrated control configuration of the hydraulic transformer 26 and the system 10, 710*d*, 710*e*, 710*f*, 710*g*. The hydraulic transformer 26 can be rapidly reconfigured on the fly. Thus, even though the timing circle 820 depicts a single valving cycle 800, the hydraulic transformer 26 can be reconfigured before the valving cycle 800 of the depicted control configuration is finished. The control configuration, including the depicted control configurations, may last many cycles or a few cycles, as needed. The control configuration, including the depicted control configurations, may be fine-tuned within a valving cycle 800 or from one valving cycle 800 to another, as needed.

The valving cycle 800 of each of the fluid chambers 650 includes an inflow period 803 and an outflow period 805. The inflow period 803 is when the inflow 802 of the hydraulic fluid into the fluid chambers 650 typically occurs, and the outflow period 805 is when the outflow 804 of the hydraulic fluid from the fluid chambers 650 typically occurs. In the depicted embodiments, the valving cycle 800 occurs once per revolution of the relative rotational movement 806 of the rotating group 600. As illustrated at FIGS. 17-19, 22, and 23, the valves 670 can open and close substantially faster than one-half of a single valving cycle 800. In the depicted embodiments, only one of the valves 670 is open to a given fluid chamber 650 at one time. In certain ways, the valves 670 and the control configuration replace or substitute for a valve plate of a conventional rotating group.

The rapid opening and closing of the valves 670 allows energy to be transferred in different directions within one valving cycle 800. The rotational inertia of the rotating group 600 and/or the momentum of moving hydraulic fluid can carry energy in the different directions and also avoid or substantially reduce hydraulic fluid throttling. In certain embodiments and certain control configurations, the inertia of the rotating group 600 and/or the momentum of the moving hydraulic fluid can cause an increase in hydraulic pressure when rapidly decelerated, similar to a hydraulic ram. In certain embodiments and certain control configurations, fluid energy from high pressure hydraulic fluid flowing to a low pressure can be captured by mechanical momentum of the rotating group 600 and the moving hydraulic fluid rather than throttling the high pressure hydraulic fluid. By reducing and/or avoiding substantial hydraulic fluid throttling, efficiency of the system 10, 710*d*, 710*e*, 710*f*, 710*g* can be high and the need to reject waste heat can be low. The rotational inertia of the rotating group 600 can be tuned to achieve desired characteristics in the hydraulic transformer 26 (e.g., rotational inertia can be added).

The mechanical clutch 40, 740 can also be used to control power flow within the system 10, 710*d*, 710*e*, 710*f*, 710*g*. Thus, energy can flow between and be redirected between various rotating shafts, and various fluid flow paths.

Figure 22:
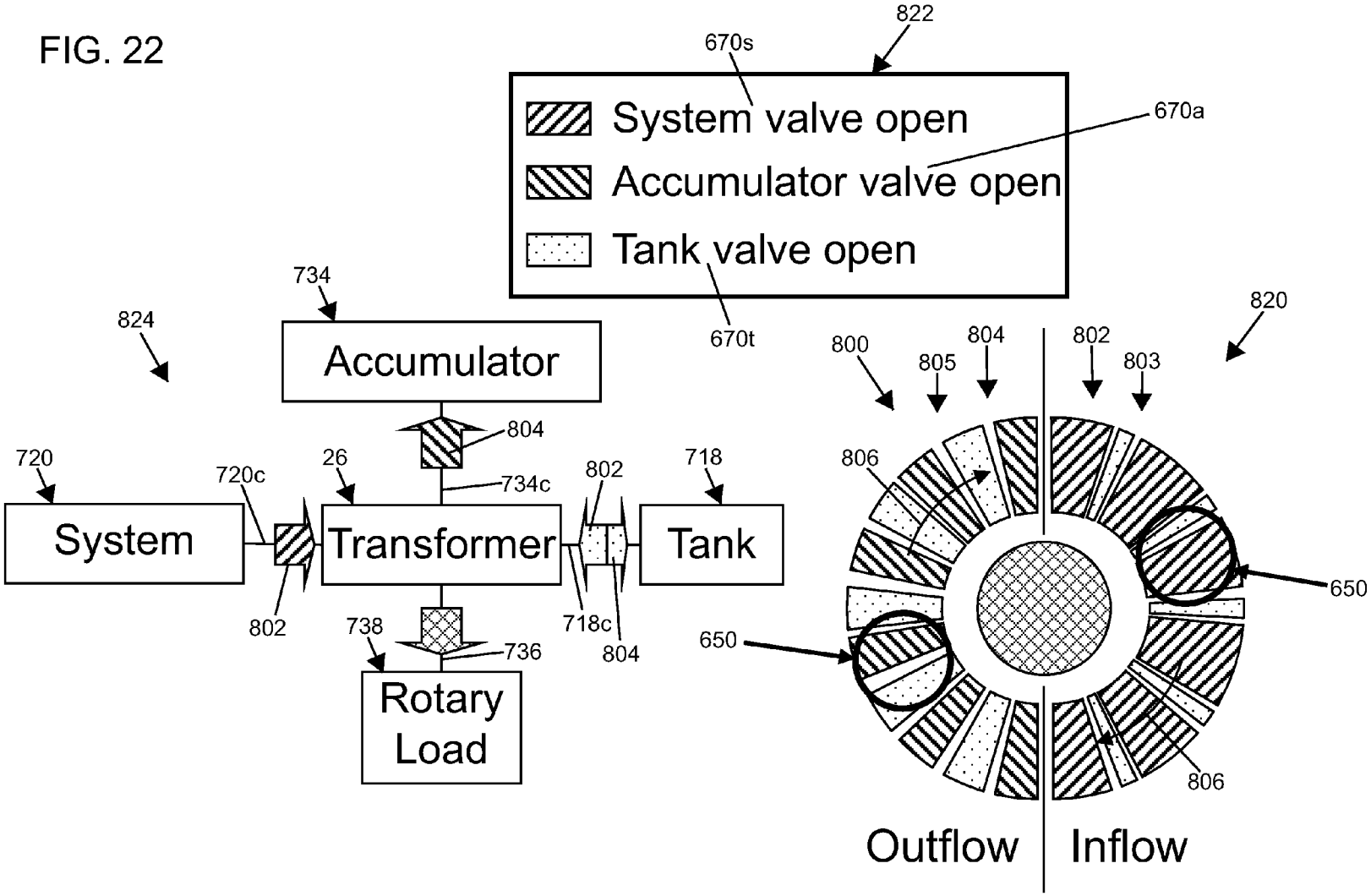
FIG. 22 is a schematic timing diagram of a seventh example operating mode in which the second through fifth hydraulic systems of FIGS. 12-15 can operate.
Figure 23:
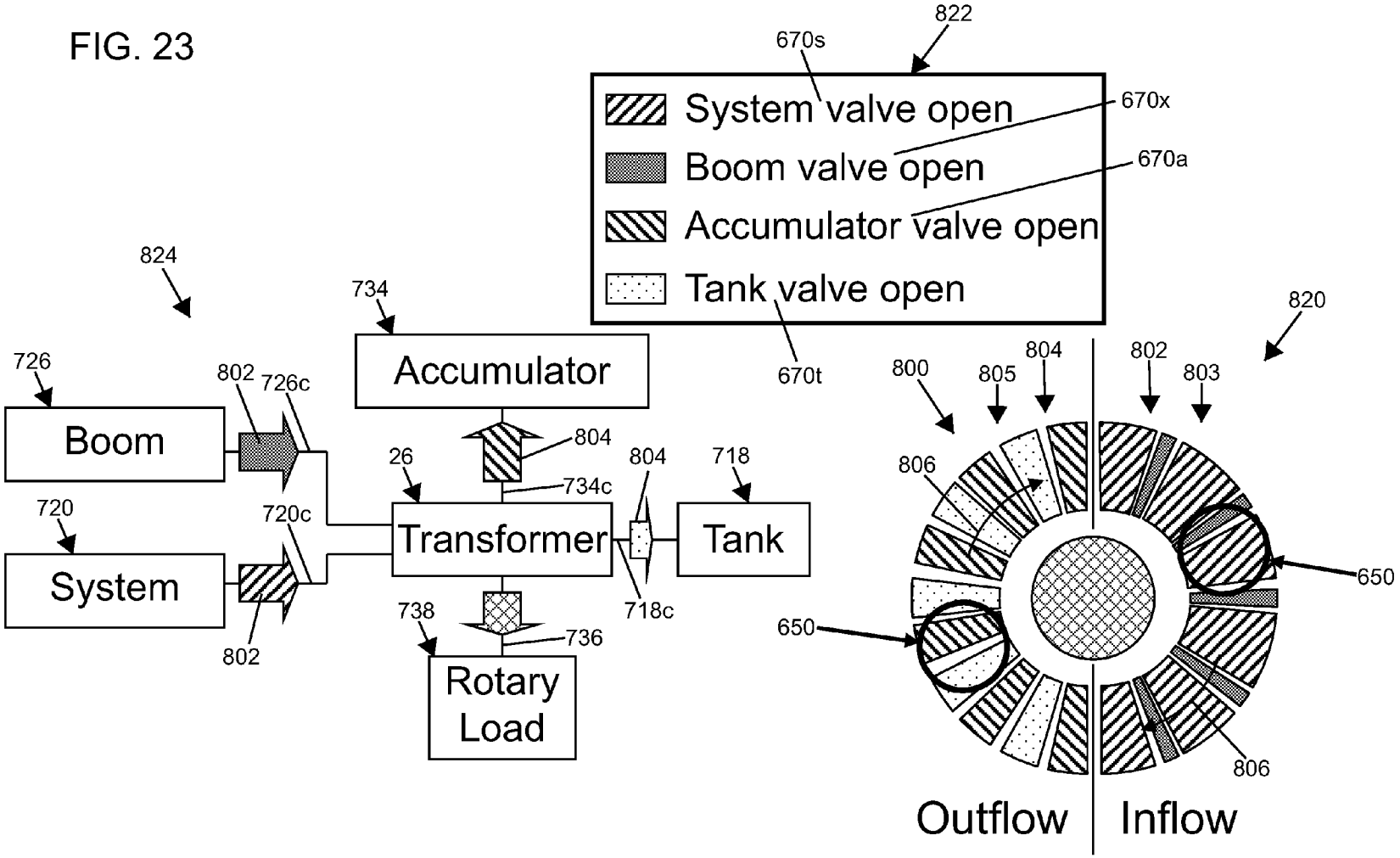
FIG. 23 is a schematic timing diagram of an eighth example operating mode in which the fifth hydraulic system of FIG. 15 can operate.

As an example, when the system 10, 710*d*, 710*e*, 710*f*, 710*g* is operated in the mode of box 64, the rotating group 600 receives hydraulic power from the supply 720 (e.g., the pump 12) and/or the auxiliary hydraulic load/supply 726 to turn the rotating group 600 and thereby the shaft 36, 736 and drive the external load 38, 738, and the rotating group 600 also sends hydraulic power to the accumulator 34, 734 by pumping hydraulic fluid into the accumulator 34, 734. In particular, as illustrated at FIGS. 22 and 23, the valving cycle 800 opens the valves 670*s* and/or 670*x* during at least a portion of the inflow period 803 of the fluid chambers 650, and the inflow 802 of the hydraulic fluid from the supply 720 and/or the auxiliary hydraulic load/supply 726 into the fluid chambers 650 causes the rotating group 600 to rotate. The valving cycle 800 also opens the valves 670*a* during at least a portion of the outflow period 805 of the fluid chambers 650 and the outflow 804 of the hydraulic fluid from the fluid chambers 650 to the accumulator 34, 734 charges the accumulator 34, 734. In addition, the rotating group 600 turns the shaft 36, 736 and thereby drives the external load 38, 738. The hydraulic power from the supply 720 and/or the auxiliary hydraulic load/supply 726 is sufficient to charge the accumulator 34, 734, drive the external load 38, 738, and accommodate any losses and/or inefficiencies. The valving cycle 800 may open the valves 670*t* during at least a portion of the inflow period 803 and/or the outflow period 805 of the fluid chambers 650, and the inflow 802 and/or the outflow 804 of the hydraulic fluid from the fluid chambers 650 to the tank 718 balances an average flow to and from the hydraulic transformer 26 to zero.

As another example, when the system 10, 710*d*, 710*e*, 710*f*, 710*g* is operated in the mode of box 66 of FIG. 2, the rotating group 600 receives power from the supply 720 (e.g., the pump 12) and/or the auxiliary hydraulic load/supply 726 and uses the power to pump hydraulic fluid into the accumulator 34, 734 to charge the accumulator 34, 734. In particular, as illustrated at FIGS. 16-19, the valving cycle 800 opens the valves 670*s* and/or 670*x* during at least a portion of the inflow period 803 of the fluid chambers 650, and the inflow 802 of the hydraulic fluid from the supply 720 and/or the auxiliary hydraulic load/supply 726 into the fluid chambers 650 causes the rotating group 600 to rotate. The valving cycle 800 also opens the valves 670*a* during at least a portion of the outflow period 805 of the fluid chambers 650 and the outflow 804 of the hydraulic fluid from the fluid chambers 650 to the accumulator 34, 734 charges the accumulator 34, 734. The hydraulic power (i.e., an average hydraulic power) from the supply 720 and/or the auxiliary hydraulic load/supply 726 equals the power (i.e., an average power) used to charge the accumulator 34, 734, neglecting certain losses and/or inefficiencies.

Figure 16:
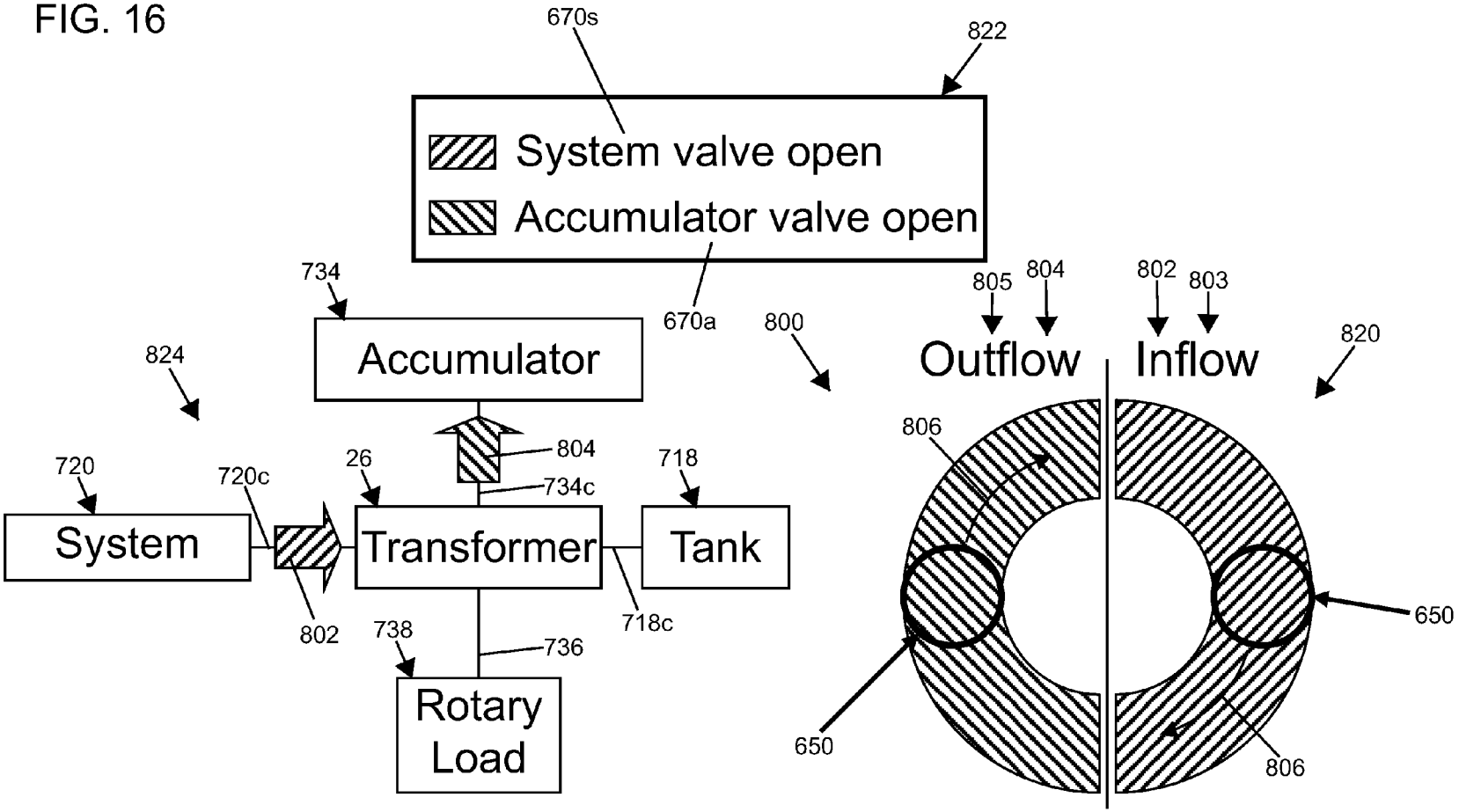
FIG. 16 is a schematic timing diagram of a first example operating mode in which the second through fifth hydraulic systems of FIGS. 12-15 can operate.
Figure 17:
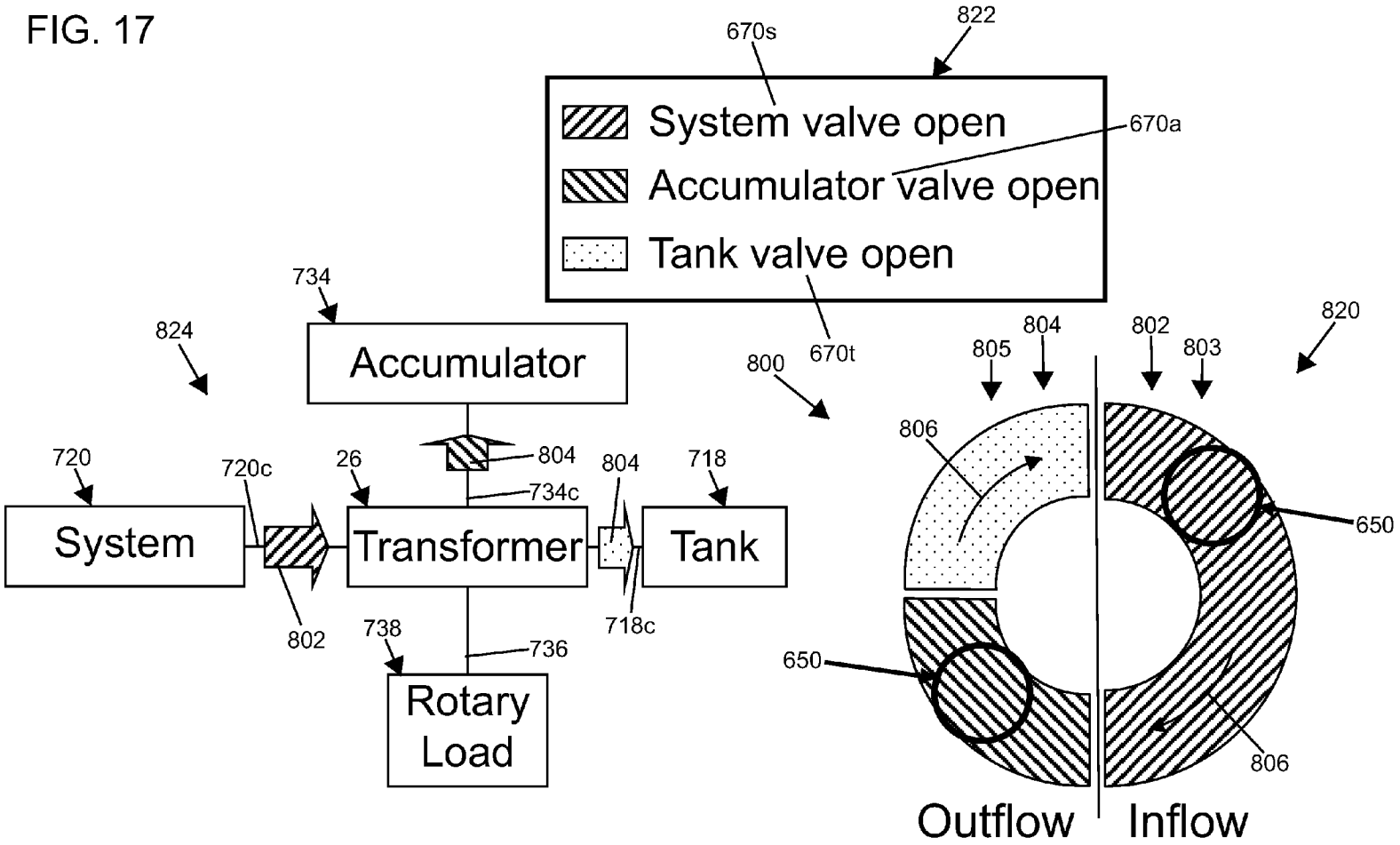
FIG. 17 is a schematic timing diagram of a second example operating mode in which the second through fifth hydraulic systems of FIGS. 12-15 can operate.
Figure 18:
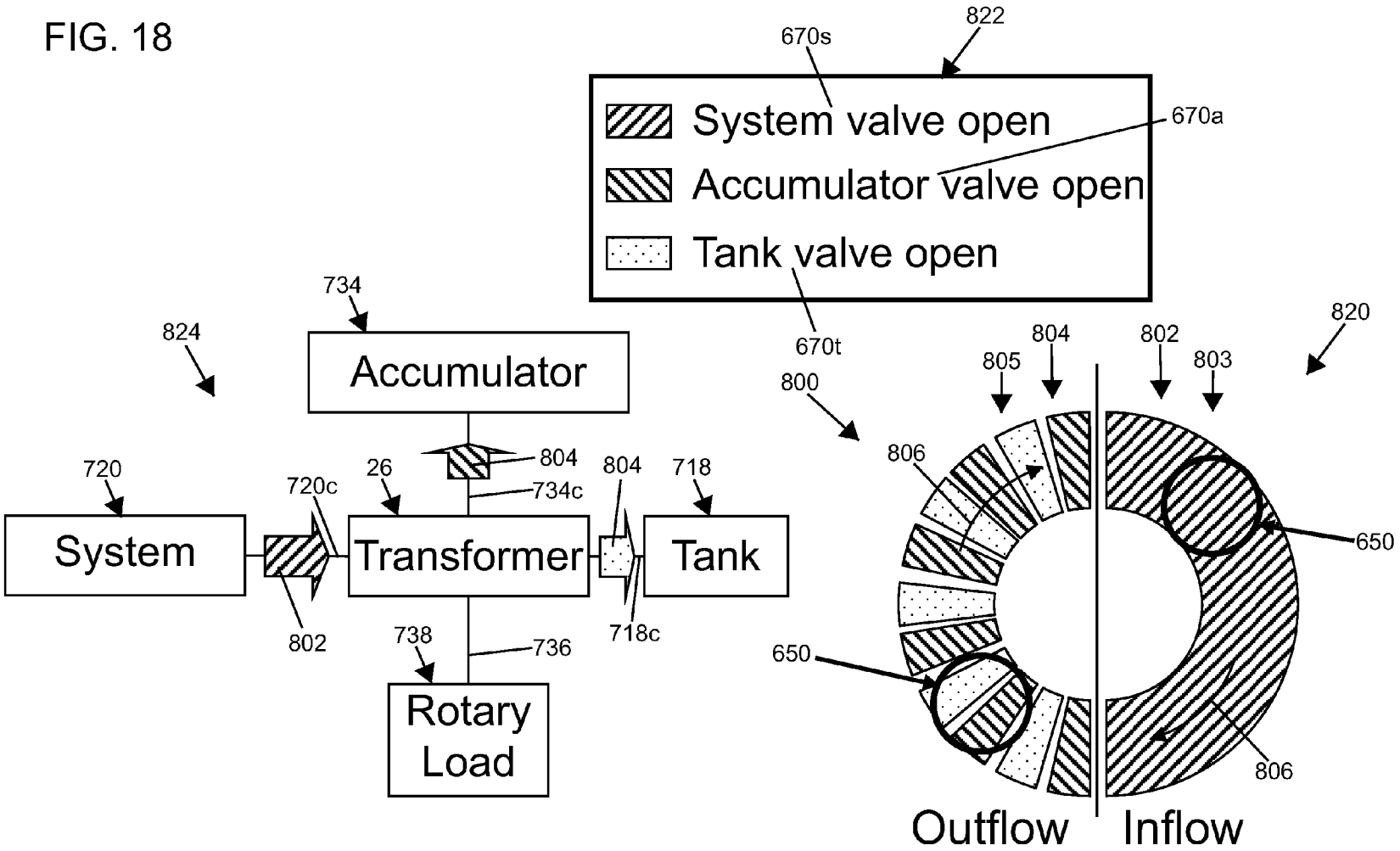
FIG. 18 is a schematic timing diagram of a third example operating mode in which the second through fifth hydraulic systems of FIGS. 12-15 can operate.
Figure 19:
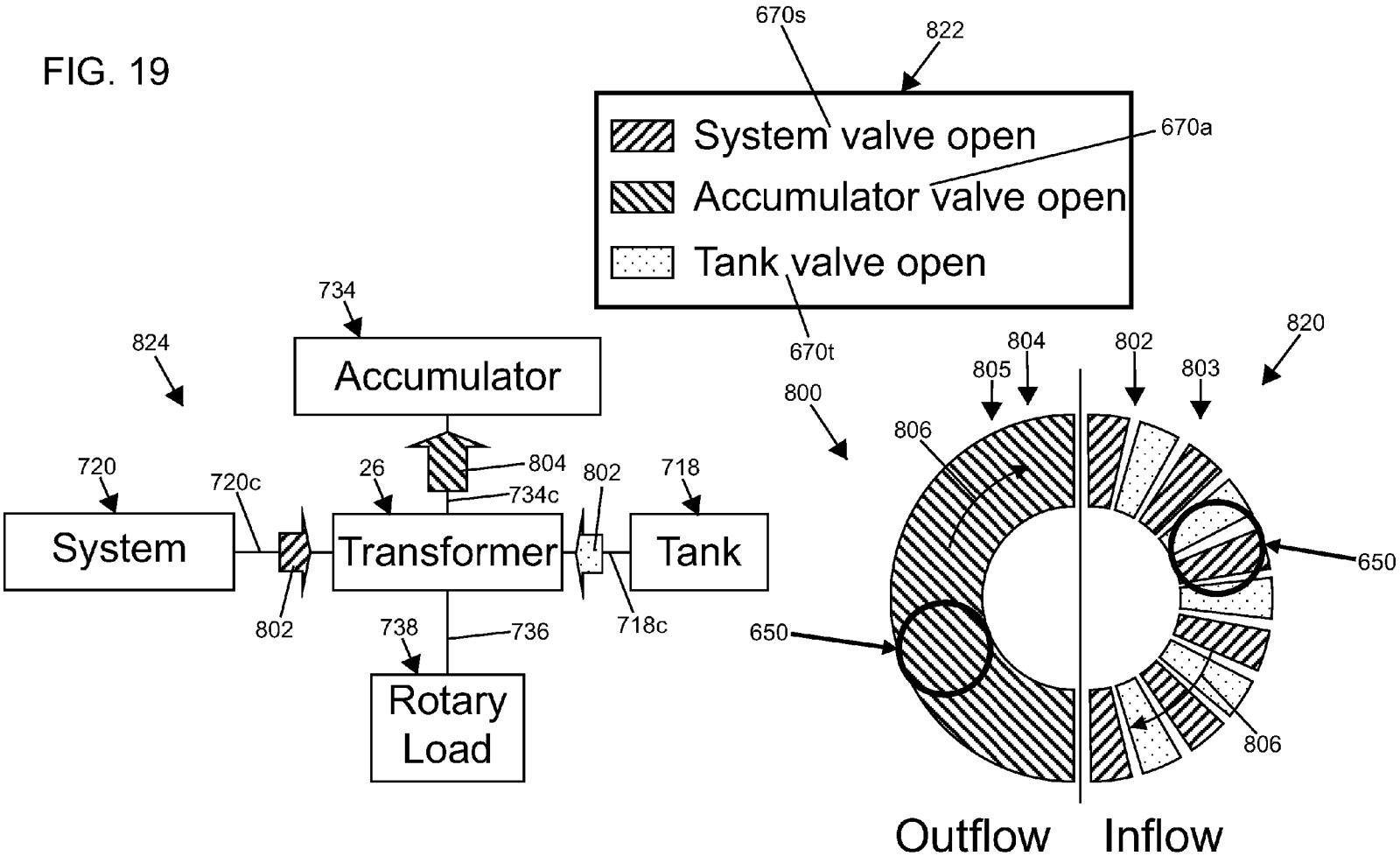
FIG. 19 is a schematic timing diagram of a fourth example operating mode in which the second through fifth hydraulic systems of FIGS. 12-15 can operate.

FIGS. 16-19 further illustrate the discretely continuous and variable nature of the hydraulic transformer 26, 26*d*, 26*e*, 26*f*, 26*g*. The control system 10, 710*d*, 710*e*, 710*f*, 710*g* can rapidly open and close the valves 670 to continuously tune and/or adjust the hydraulic transformer 26 for the task or tasks at hand. In the examples of FIGS. 16-19, the process of charging and/or discharging the accumulator 34, 734 is illustrated as a variable process as accumulator pressure typically varies as the accumulator 34, 734 is charged and/or discharged. As the accumulator 34, 734 is charged, the accumulator pressure typically increases, and as the accumulator 34, 734 is discharged, the accumulator pressure typically decreases. In contrast, supply pressure supplied by the supply 720 is often held constant and/or is generally different from the accumulator pressure. To accommodate the difference between the accumulator pressure and the supply pressure, the hydraulic transformer 26 may adjust opening frequency and/or opening duration of the valves 670. This may be done without substantial throttling of hydraulic fluid flow. FIG. 16 illustrates an instant where the accumulator pressure and the supply pressure match and the hydraulic fluid flow to the accumulator 34, 734 from the hydraulic transformer 26 matches the hydraulic fluid flow to the hydraulic transformer 26 from the supply 720. FIG. 17 illustrates an instant where the accumulator pressure is higher than the supply pressure and the hydraulic fluid flow to the accumulator 34, 734 from the hydraulic transformer 26 is less than the hydraulic fluid flow to the hydraulic transformer 26 from the supply 720. Hydraulic fluid flow from the hydraulic transformer 26 to the tank 718 balances an average flow to and from the hydraulic transformer 26 to zero. FIG. 18 is similar to FIG. 17 but illustrates a higher valve frequency and thereby results in a smoother rotational speed of the rotating group 600. FIG. 19 illustrates an instant where the accumulator pressure is lower than the supply pressure and the hydraulic fluid flow to the accumulator 34, 734 from the hydraulic transformer 26 is greater than the hydraulic fluid flow to the hydraulic transformer 26 from the supply 720. Hydraulic fluid flow to the hydraulic transformer 26 from the tank 718 balances an average flow to and from the hydraulic transformer 26 to zero.

As another example, when the system 10, 710*d*, 710*e*, 710*f*, 710*g* is operated in the mode of box 68 of FIG. 2, energy (e.g., inertial energy) from the external load 38, 738 turns the shaft 36, 736, and the rotating group 600 takes power off the shaft 36, 736 and uses the power to pump hydraulic fluid into the accumulator 34, 734 to charge the accumulator 34, 734. Hydraulic energy from the supply 720 (e.g., the pump 12) and/or the auxiliary hydraulic load/supply 726 can also be concurrently received by the rotating group 600 and also be used to charge the accumulator 34, 734. In particular, the shaft 36, 736 causes the rotating group 600 to rotate and supplies the rotating group 600 with rotating shaft power. The valving cycle 800 opens the valves 670*s* and/or 670*x* during at least a portion of the inflow period 803 of the fluid chambers 650, and the inflow 802 of the hydraulic fluid from the supply 720 and/or the auxiliary hydraulic load/supply 726 into the fluid chambers 650 also causes the rotating group 600 to rotate and supplies the rotating group 600 with hydraulic fluid power. The valving cycle 800 may also open the valves 670*t* during at least a portion of the inflow period 803 of the fluid chambers 650, and the inflow 802 of the hydraulic fluid from the tank 718 into the fluid chambers 650 is caused by the rotation of the rotating group 600. The valving cycle 800 also opens the valves 670*a* during at least a portion of the outflow period 805 of the fluid chambers 650 and the outflow 804 of the hydraulic fluid from the fluid chambers 650 to the accumulator 34, 734 charges the accumulator 34, 734. Thus, the rotating group 600 is turned by the shaft 36, 736 and thereby receives/recovers energy from the external load 38, 738. The hydraulic power from the supply 720 and/or the auxiliary hydraulic load/supply 726 supplements the energy from the external load 38, 738 and also charges the accumulator 34, 734.

Figure 20:
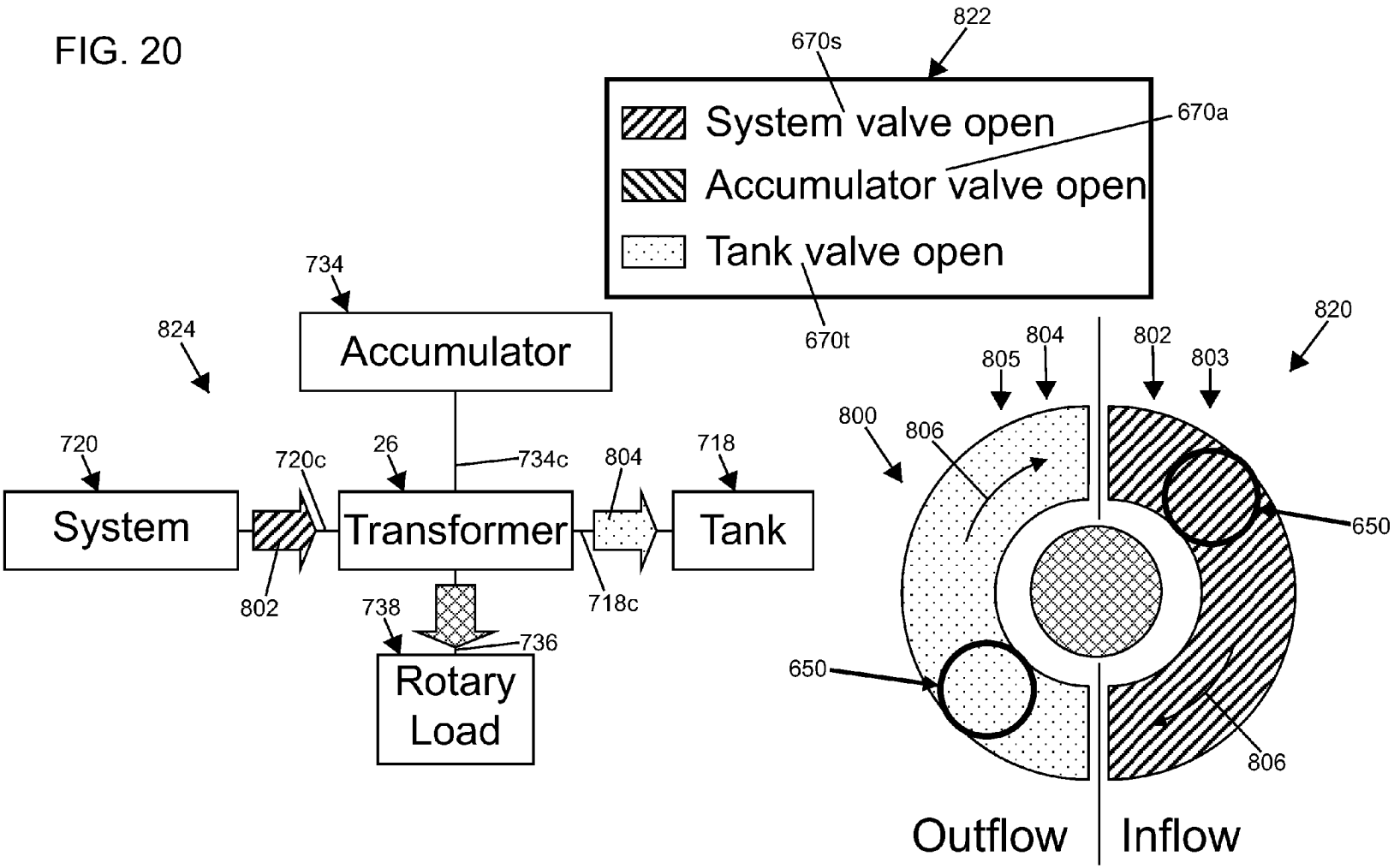
FIG. 20 is a schematic timing diagram of a fifth example operating mode in which the second through fifth hydraulic systems of FIGS. 12-15 can operate.

As another example, when the system 10, 710*d*, 710*e*, 710*f*, 710*g* is operated in the mode of box 70 of FIG. 2, the rotating group 600 receives power from the supply 720 (e.g., the pump 12) and/or the auxiliary hydraulic load/supply 726 and turns the shaft 36, 736 to drive the external load 38, 738. Thus, the hydraulic transformer 26, 26*d*, 26*e*, 26*f*, 26*g* operates as a hydraulic motor of either variable or fixed displacement. In particular, as illustrated at FIG. 20, the valving cycle 800 opens the valves 670*s* and/or 670*x* during at least a portion of the inflow period 803 of the fluid chambers 650, and the inflow 802 of the hydraulic fluid from the supply 720 and/or the auxiliary hydraulic load/supply 726 into the fluid chambers 650 causes the rotating group 600 to rotate. The valving cycle 800 may also open the valves 670*t* during at least a portion of the outflow period 805 of the fluid chambers 650, and the outflow 804 of the hydraulic fluid from the fluid chambers 650 to the tank 718 balances an average flow to and from the hydraulic transformer 26 to zero. The rotating group 600 thereby turns the shaft 36, 736 and thereby drives the external load 38, 738. The hydraulic power from the supply 720 and/or the auxiliary hydraulic load/supply 726 is sufficient to drive the external load 38, 738, and accommodate any losses and/or inefficiencies.

As another example, when the system 10, 710*d*, 710*e*, 710*f*, 710*g* is operated in the mode of box 72 of FIG. 2, the hydraulic transformer 26, 26*d*, 26*e*, 26*f*, 26*g* does not transfer substantial energy and may operate with a net zero displacement. In particular, the shaft 36, 736 may or may not cause the rotating group 600 to rotate and may freewheel. The valving cycle 800 may close the valves 670*s*, 670*x*, and 670*a* during the inflow period 803 and the outflow period 805 of the fluid chambers 650. The valving cycle 800 may also open the valves 670*t* during the inflow period 803 and the outflow period 805 of the fluid chambers 650.

Figure 21:
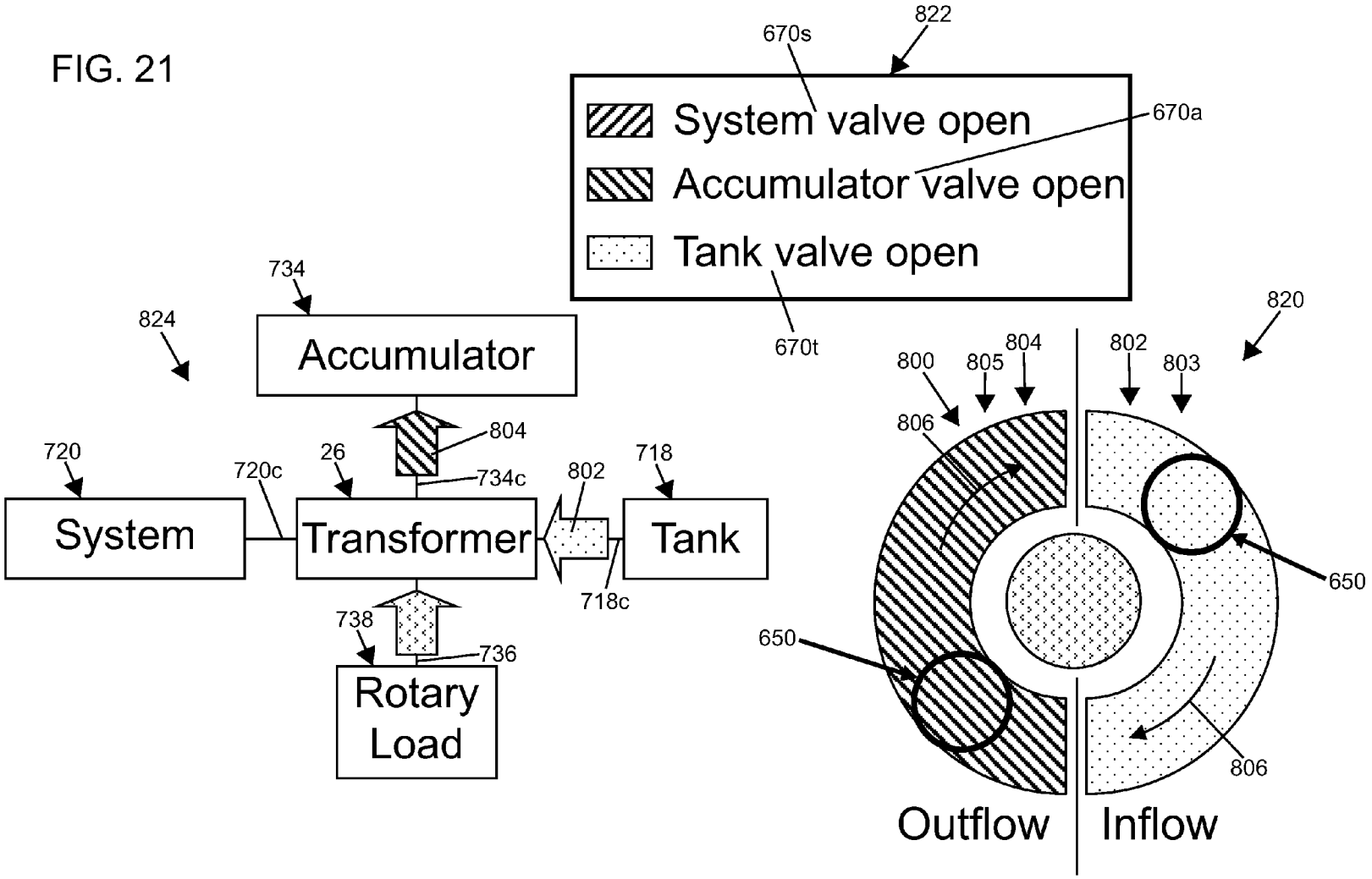
FIG. 21 is a schematic timing diagram of a sixth example operating mode in which the second through fifth hydraulic systems of FIGS. 12-15 can operate.

As another example, when the system 10, 710*d*, 710*e*, 710*f*, 710*g* is operated in the mode of box 74 of FIG. 2, energy (e.g., inertial energy) from the external load 38, 738 turns the shaft 36, 736, and the rotating group 600 takes power off the shaft 36, 736 and uses the power to pump hydraulic fluid into the accumulator 34, 734 to charge the accumulator 34, 734. Thus, the hydraulic transformer 26, 26*d*, 26*e*, 26*f*, 26*g* operates as a hydraulic pump of either variable or fixed displacement. In particular, as illustrated at FIG. 21, the shaft 36, 736 causes the rotating group 600 to rotate and supplies the rotating group 600 with rotating shaft power. The valving cycle 800 opens the valves 670*t* during at least a portion of the inflow period 803 of the fluid chambers 650, and the inflow 802 of the hydraulic fluid from the tank 718 into the fluid chambers 650 is caused by the rotation of the rotating group 600. The valving cycle 800 also opens the valves 670*a* during at least a portion of the outflow period 805 of the fluid chambers 650 and the outflow 804 of the hydraulic fluid from the fluid chambers 650 to the accumulator 34, 734 charges the accumulator 34, 734. Thus, the rotating group 600 is turned by the shaft 36, 736 and thereby receives/recovers energy from the external load 38, 738 and stores the energy in the accumulator 34, 734.

As another example, when the system 10, 710*d*, 710*e*, 710*f*, 710*g* is operated in the mode of box 76 of FIG. 2, the rotating group 600 receives power from the charged accumulator 34, 734 to drive the rotating group 600 and thereby turn the shaft 36, 736 and drive the external load 38, 738. The rotating group 600 also sends hydraulic power to the auxiliary hydraulic load/supply 726. In particular, the valving cycle 800 opens the valves 670*a* during at least a portion of the inflow period 803 of the fluid chambers 650, and the inflow 802 of the hydraulic fluid from the accumulator 34, 734 into the fluid chambers 650 causes the rotating group 600 to rotate. The valving cycle 800 also opens the valves 670*x* during at least a portion of the outflow period 805 of the fluid chambers 650 and the outflow 804 of the hydraulic fluid from the fluid chambers 650 to the auxiliary hydraulic load/supply 726 may be used to drive hydraulic cylinders, hydraulic motors, etc. In addition, the rotating group 600 turns the shaft 36, 736 and thereby drives the external load 38, 738. The valving cycle 800 may open the valves 670*t* during at least a portion of the inflow period 803 and/or the outflow period 805 of the fluid chambers 650, and the inflow 802 and/or the outflow 804 of the hydraulic fluid from the fluid chambers 650 to the tank 718 balances an average flow to and from the hydraulic transformer 26 to zero.

As another example, when the system 10, 710*d*, 710*e*, 710*f*, 710*g* is operated in the mode of box 78 of FIG. 2, the rotating group 600 receives power from the charged accumulator 34, 734 to drive the rotating group 600 and thereby send hydraulic power to the auxiliary hydraulic load/supply 726. In particular, the valving cycle 800 opens the valves 670*a* during at least a portion of the inflow period 803 of the fluid chambers 650, and the inflow 802 of the hydraulic fluid from the accumulator 34, 734 into the fluid chambers 650 causes the rotating group 600 to rotate. The valving cycle 800 also opens the valves 670*x* during at least a portion of the outflow period 805 of the fluid chambers 650 and the outflow 804 of the hydraulic fluid from the fluid chambers 650 to the auxiliary hydraulic load/supply 726 may be used to drive hydraulic cylinders, hydraulic motors, etc. The valving cycle 800 may open the valves 670*t* during at least a portion of the inflow period 803 and/or the outflow period 805 of the fluid chambers 650, and the inflow 802 and/or the outflow 804 of the hydraulic fluid from the fluid chambers 650 to the tank 718 balances an average flow to and from the hydraulic transformer 26 to zero.

As another example, when the system 10, 710*d*, 710*e*, 710*f*, 710*g* is operated in the mode of box 80 of FIG. 2, the rotating group 600 receives power from the charged accumulator 34, 734 to drive the rotating group 600 and thereby sends hydraulic power to the auxiliary hydraulic load/supply 726. In addition, energy (e.g., inertial energy) from the external load 38, 738 turns the shaft 36, 736, and the rotating group 600 takes power off the shaft 36, 736 and uses the power to send additional hydraulic power to the auxiliary hydraulic load/supply 726. In particular, the valving cycle 800 opens the valves 670*a* during at least a portion of the inflow period 803 of the fluid chambers 650, and the inflow 802 of the hydraulic fluid from the accumulator 34, 734 into the fluid chambers 650 causes the rotating group 600 to rotate. The valving cycle 800 also opens the valves 670*x* during at least a portion of the outflow period 805 of the fluid chambers 650, and the outflow 804 of the hydraulic fluid from the fluid chambers 650 to the auxiliary hydraulic load/supply 726 may be used to drive hydraulic cylinders, hydraulic motors, etc. The valving cycle 800 may open the valves 670*t* during at least a portion of the inflow period 803 and/or the outflow period 805 of the fluid chambers 650, and the inflow 802 and/or the outflow 804 of the hydraulic fluid from the fluid chambers 650 to the tank 718 balances an average flow to and from the hydraulic transformer 26 to zero.

In addition to the examples mentioned above, the system 10, 710*d*, 710*e*, 710*f*, 710*g* can operate in other operating modes, including various combinations of the above examples. Another operating mode includes simultaneously transferring hydraulic energy from the accumulator 34, 734, the supply 720 (e.g., the pump 12), and/or the auxiliary hydraulic load/supply 726 to the external load 38, 738. Another operating mode includes transferring hydraulic energy from the supply 720 (e.g., the pump 12) to the auxiliary hydraulic load/supply 726. The auxiliary hydraulic load/supply 726 can include a variety of hydraulic components and loads including hydraulic cylinders, hydraulic pumps, hydraulic motors, hydraulic accumulators, gravity loads, inertial loads, etc. In certain operating modes energy is recovered and recycled from the loads (e.g., gravity loads, inertial loads, spring loads, etc.). Various examples are also given at the related U.S. provisional patent application Ser. No. 61/523,099, filed Aug. 12, 2011, entitled System and Method for Recovering Energy and Leveling Hydraulic System Loads, and incorporated by reference above.

By controlling (e.g., individually controlling) the frequency and the duration of the opening of the valves 670, the displacement rates and pressures to and from the displacement destinations and the displacement originations of the hydraulic fluid from and to the hydraulic transformer 26 can be converted back and forth or converted back and forth as rotational shaft power used to drive the external load 38, 738 and/or received from the external load 38, 738. For example, when a deceleration of the external load 38, 738 is desired, the hydraulic transformer 26 can act as a pump taking low pressure fluid from the tank 18, 718 and directing it either to the accumulator 34, 734 for storage, to the auxiliary hydraulic load/supply 726, or a combination of the two. By using the clutch 40, 740 to disengage the output/input shaft 36, 736 from the external load 38, 738, the hydraulic transformer 26 can function as a stand-alone hydraulic transformer when no shaft work is required to be applied to the external load 38, 738. By deleting or not using the output/input shaft 36, 736, the hydraulic transformer 26 can function as a conventional hydraulic transformer. For example, this is achieved by taking hydraulic fluid energy from the supply 720 (e.g., the pump 12) at whatever pressure is dictated by the other associated system loads and storing the hydraulic fluid energy, without throttling, at the current accumulator pressure in the accumulator 34, 734. In the same way, unthrottled hydraulic fluid energy can also be taken from and/or delivered to the accumulator 34, 734 at its current pressure and supplied to and/or received from the system (e.g., the auxiliary hydraulic load/supply 726) at the desired operating pressure. Proportioning of power flow by the hydraulic transformer 26 can be controlled by controlling the frequency and the duration of the opening of the valves 670. In certain embodiments, aspects of the present disclosure can be used in systems without a clutch for disengaging a connection between the output/input shaft 36, 736 and the external load 38, 738.

Figure 24:
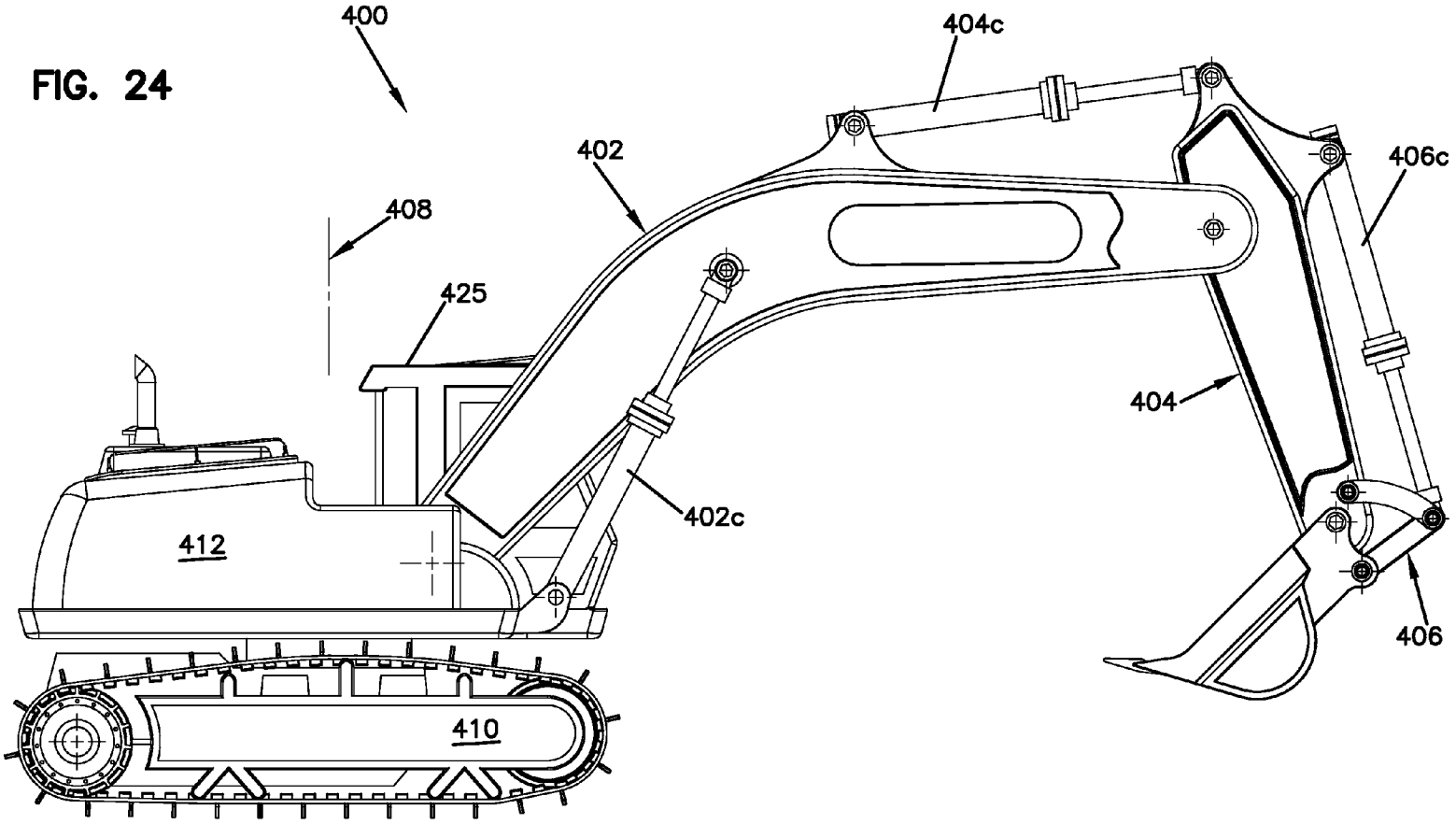
FIGS. 24 and 25 schematically show a mobile piece of excavation equipment that is an example of one type of machine on which hydraulic systems in accordance with the principles of the present disclosure can be used.
Figure 25:
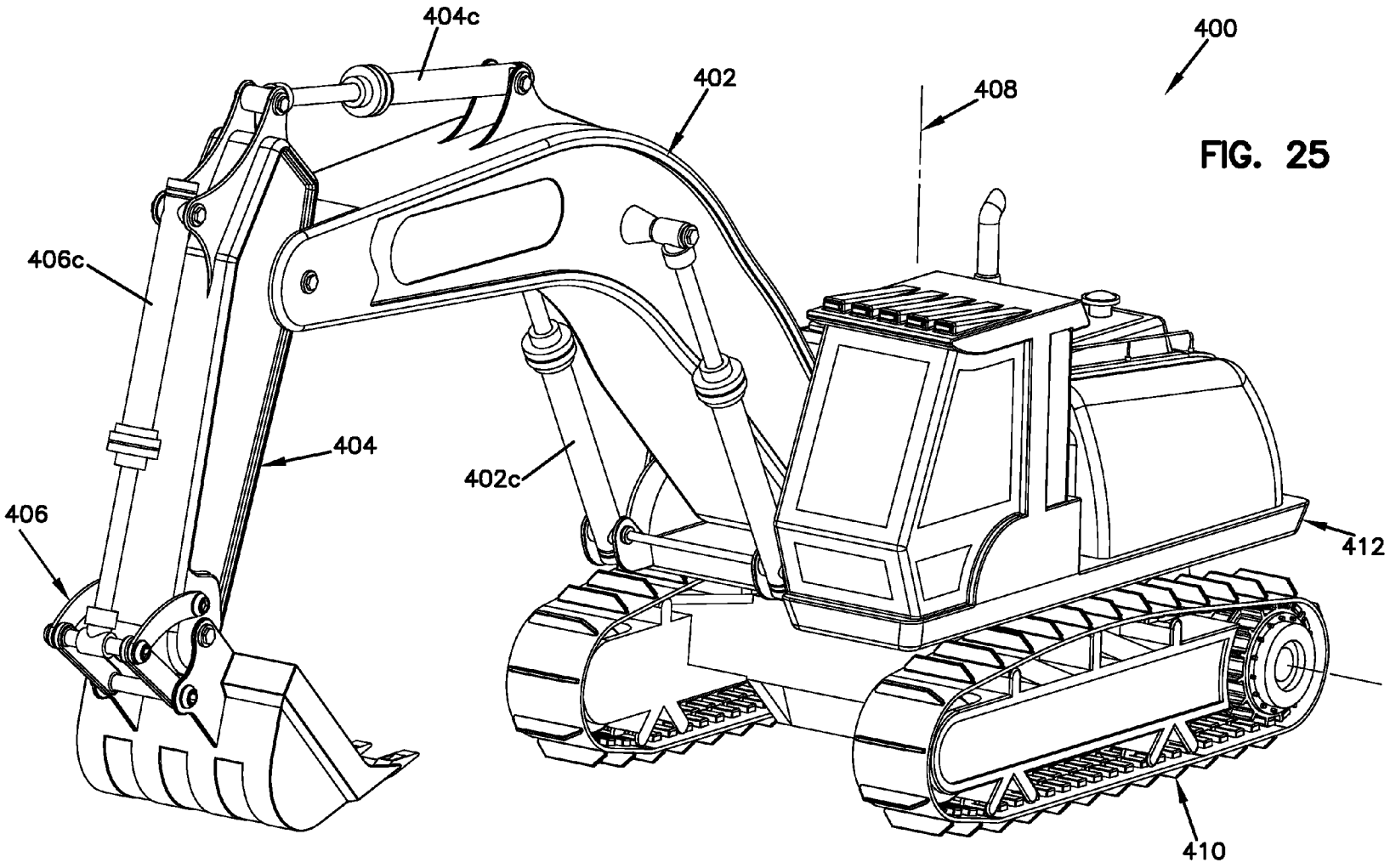

In certain example embodiments, hydraulic circuit configurations of the type described above can be incorporated into a piece of mobile excavation equipment such as an excavator. For example, FIGS. 24 and 25 depict an example excavator 400 including an upper structure 412 supported on an undercarriage 410. The undercarriage 410 includes a propulsion structure for carrying the excavator 400 across the ground. For example, the undercarriage 410 can include left and right tracks. The upper structure 412 is pivotally movable relative to the undercarriage 410 about a pivot axis 408 (i.e., a swing axis). In certain embodiments, transformer input/output shafts of the type described above can be used for pivoting the upper structure 412 about the swing axis 408 relative to the undercarriage 410.

The upper structure 412 can support and carry the prime mover 14 of the machine and can also include a cab 425 in which the operator interface 43, 743 is provided. A boom 402 is carried by the upper structure 412 and is pivotally moved between raised and lowered positions by a boom cylinder 402*c*. An arm 404 is pivotally connected to a distal end of the boom 402. An arm cylinder 404*c* is used to pivot the arm 404 relative to the boom 402. The excavator 400 also includes a bucket 406 pivotally connected to a distal end of the arm 404. A bucket cylinder 406*c* is used to pivot the bucket 406 relative to the arm 404. In certain embodiments, the boom cylinder 402*c*, the arm cylinder 404*c* and the bucket cylinder 406*c* can be part of system load circuits of the type described above. For example, the auxiliary hydraulic load/supply 726 can drive the boom cylinder 402*c*.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

The invention claimed is:

1. A hydraulic system comprising:

an accumulator; and a hydraulic transformer including a rotating group rotationally coupled to a rotatable shaft, the rotatable shaft adapted for connection to an external load, the hydraulic transformer further including a plurality of valve sets, each of the valve sets including a first valve that fluidly connects a hydraulic pump to the hydraulic transformer via a pump line, a second valve that fluidly connects a tank to the hydraulic transformer via a tank line, and a third valve that fluidly connects the accumulator to the hydraulic transformer via an accumulator line, wherein the pump line, tank line, and accumulator line are separate from one another.

2. The hydraulic system of claim 1, wherein the rotating group is rotationally coupled to the rotatable shaft by a common drive member.

3. The hydraulic system of claim 2, wherein the hydraulic transformer includes an axial piston pump-motor that includes the rotating group and the common drive member is a swashplate.

4. The hydraulic system of claim 2, wherein the hydraulic transformer includes a radial piston pump-motor that includes the rotating group and the common drive member is a crankshaft.

5. The hydraulic system of claim 2, wherein the hydraulic transformer includes a gerotor pump-motor that includes the rotating group and the common drive member is an inner rotor.

6. The hydraulic system of claim 1, wherein the rotating group of the hydraulic transformer includes a plurality of pumping chambers each fluidly connected to a corresponding one of the plurality of valve sets.

7. The hydraulic system of claim 6, wherein each one of the plurality of pumping chambers is fluidly connected to only one valve set of the plurality of valve sets.

8. The hydraulic system of claim 1, further comprising a hydraulic cylinder for raising and lowering a work item, the hydraulic cylinder being fluidly connected to a fourth valve of each of the plurality of valve sets, wherein the fourth valve fluidly connects to the hydraulic cylinder when the work item is being lowered by the hydraulic cylinder.

9. The hydraulic system of claim 1, further comprising a hydraulic cylinder for raising and lowering a work item, the hydraulic cylinder being fluidly connected to a fourth valve of each of the plurality of valve sets, wherein the fourth valve fluidly connects to the hydraulic cylinder when the work item is being raised by the hydraulic cylinder.

10. The hydraulic system of claim 1, further comprising a hydraulic component that transforms energy between hydraulic fluid energy and mechanical energy, the hydraulic component being fluidly connected to a fourth valve of each of the plurality of valve sets, wherein the fourth valve fluidly connects to the hydraulic component when the energy is being transformed.

11. The hydraulic system of claim 10, wherein, when the energy is transformed from the hydraulic fluid energy to the mechanical energy, the hydraulic transformer transfers the energy to the hydraulic component.

12. The hydraulic system of claim 10, wherein, when the energy is transformed from the mechanical energy to the hydraulic fluid energy, the hydraulic component transfers the energy to the hydraulic transformer.

13. The hydraulic system of claim 10, wherein at least a portion of the hydraulic fluid energy is transferred between the hydraulic transformer and the accumulator.

14. The hydraulic system of claim 1, wherein the rotating group of the hydraulic transformer includes a plurality of pumping chambers and wherein the rotatable shaft is mechanically connected to a housing of the plurality of pumping chambers.

15. The hydraulic system of claim 1, wherein the rotating group of the hydraulic transformer includes a swashplate, a crankshaft, or an inner rotor and wherein the rotatable shaft is mechanically connected to the swashplate, the crankshaft, or the inner rotor.

16. The hydraulic system of claim 1, wherein the rotatable shaft is selectively connected to the external load.

17. The hydraulic system of claim 1, wherein the external load is a non-hydraulic load.

18. A system comprising:

a prime mover;

a hydraulic pump powered by the prime mover; and a fluid circuit powered by the hydraulic pump, the fluid circuit including a hydraulic transformer having an input/output shaft adapted for connection to a non-hydraulic external load, the hydraulic transformer being fluidly connected to a hydraulic accumulator, and the hydraulic transformer providing a plurality of operations including:

a) a first operation in which the hydraulic transformer receives energy corresponding to a deceleration of the external load from the input/output shaft and transfers at least a portion of the energy received from the deceleration of the external load to the hydraulic accumulator;

b) a second operation in which the hydraulic transformer receives at least a portion of the energy from the hydraulic accumulator and transfers at least a portion of the energy received from the hydraulic accumulator to the external load through the input/output shaft;

c) a third operation in which the hydraulic transformer receives energy from the hydraulic pump and transfers at least a portion of the energy received from the hydraulic pump to the hydraulic accumulator; and d) a fourth operation in which the hydraulic transformer receives the energy from the hydraulic pump and transfers at least a portion of the energy received from the hydraulic pump to the external load through the input/output shaft.

19. The system of claim 18, wherein the hydraulic transformer also provides a fifth operation of transferring the energy received from the deceleration of the external load from the input/output shaft to the fluid circuit for delivery to other hydraulic loads.

20. The system of claim 18, wherein the hydraulic transformer includes a single rotating group.

21. The system of claim 20, wherein the hydraulic transformer provides at least two of the plurality of the operations in one revolution of the single rotating group.

22. The system of claim 20, wherein the hydraulic transformer provides at least three of the plurality of the operations in one revolution of the single rotating group.

23. A hydraulic system comprising:

a high pressure hydraulic fluid supply;

a low pressure hydraulic fluid reservoir;

a rotating group including a plurality of fluid chambers operably connected to a common drive member such that relative rotation between the plurality of fluid chambers and the common drive member is coupled with hydraulic fluid flow;

a rotational frequency and a rotational period corresponding to the relative rotation between the plurality of fluid chambers and the common drive member; and a plurality of valve sets, each of the valve sets valving only a corresponding separate one of the plurality of fluid chambers, each of the valve sets including a first valve that fluidly connects and disconnects only the corresponding one of the plurality of fluid chambers with the high pressure hydraulic fluid supply, a second valve that fluidly connects and disconnects only the corresponding one of the plurality of fluid chambers with the low pressure hydraulic fluid reservoir, and a third valve that fluidly connects and disconnects only the corresponding one of the plurality of fluid chambers with an alternate fluid path, each of the valves of each of the valve sets having a valving frequency and a valving period corresponding to a connect-disconnect-connect cycle of the valve.

24. The hydraulic system of claim 23, wherein at least one of the first valve, the second valve, and the third valve is adapted to operate with the valving period set to less than half of the rotational period.

25. The hydraulic system of claim 23, further comprising an input/output shaft rotationally coupled to the rotating group and adapted to transfer power between fluid power of the hydraulic fluid flow and rotational power of the input/output shaft.

26. The hydraulic system of claim 25, wherein the input/output shaft is rotationally coupled to the common drive member.

27. The hydraulic system of claim 25, wherein the input/output shaft is rotationally coupled to the plurality of fluid chambers.

28. The hydraulic system of claim 23, further comprising a hydraulic accumulator, wherein the third valve of each of the valve sets of the plurality of valve sets fluidly connects and disconnects the corresponding one of the plurality of fluid chambers with the hydraulic accumulator.

29. The hydraulic system of claim 23, further comprising a hydraulic component, wherein each of the valve sets of the plurality of valve sets further includes a fourth valve that fluidly connects and disconnects the corresponding one of the plurality of fluid chambers with the hydraulic component.

30. The hydraulic system of claim 23, further comprising a hydraulic component, wherein the third valve of each of the valve sets of the plurality of valve sets fluidly connects and disconnects the corresponding one of the plurality of fluid chambers with the hydraulic component.

31. The hydraulic system of claim 30, wherein the hydraulic component is a hydraulic pump-motor.

32. A hydraulic transformer adapted to transfer hydraulic flow energy between a first hydraulic flow with a first pressure and a first flow rate and a second hydraulic flow with a second pressure and a second flow rate, the hydraulic transformer comprising:

a single rotating group including a plurality of fluid chambers operably connected to a common drive member such that relative rotation about an axis between the plurality of fluid chambers and the common drive member is coupled with hydraulic fluid flow through the hydraulic transformer; and a plurality of valve sets, each of the valve sets valving a corresponding separate one of the plurality of fluid chambers, each of the valve sets including:

a first valve that fluidly connects and disconnects only the corresponding one of the plurality of fluid chambers with a pump;

a second valve that fluidly connects and disconnects only the corresponding one of the plurality of fluid chambers with a tank; and a third valve that fluidly connects and disconnects only the corresponding one of the plurality of fluid chambers with an alternate fluid path.

33. The hydraulic transformer of claim 32, wherein each of the valves of each of the valve sets has a valving period of less than half of a relative rotational period of the relative rotation between the plurality of fluid chambers and the common drive member.

* * * * *